US005778703A

United States Patent [19]

Imai et al.

[11] Patent Number: 5,778,703

[45] Date of Patent: Jul. 14, 1998

[54] WASHING MACHINE WITH IMPROVED DRIVE STRUCTURE FOR ROTATABLE TUB AND AGITATOR

[75] Inventors: Masahiro Imai, Tajimi; Hiroshi Nishimura, Seto; Masaru Koshimizu, Komaki; Koichi Hosomi, Seto; Kazunobu Nagai, Aichi-ken; Isamu Nitta, Kasugai; Yutaka Inagaki, Fuji, all of Japan

[73] Assignee: Kabushiki Kaisha Toshiba, Kanagawa-Ken, Japan

[21] Appl. No.: 773,681

[22] Filed: Dec. 24, 1996

[51] Int. Cl.[6] ..... D06F 37/40

[52] U.S. Cl. ..... 68/12.02; 68/23.7

[58] Field of Search ..... 68/12.02, 23.7

[56] References Cited

U.S. PATENT DOCUMENTS

| | | | |
|---|---|---|---|
| 2,656,702 | 10/1953 | Chapin | 68/23.7 X |
| 4,689,973 | 9/1987 | Hershberger | 68/23.7 |
| 4,813,248 | 3/1989 | Smith et al. | 68/23.7 |
| 5,586,455 | 12/1996 | Imai et al. | 68/23.7 X |
| 5,619,871 | 4/1997 | Forbes et al. | 68/23.7 |

*Primary Examiner*—Philip R. Coe
*Attorney, Agent, or Firm*—Limbach & Limbach, LLP

[57] ABSTRACT

A washing machine includes a hollow tub shaft mounted on a first stationary portion of the machine for rotation, a rotatable tub rotatably mounted on an upper end of the tub shaft, an agitator shaft concentrically inserted in the tub shaft for rotation, an agitator mounted on the upper end of the agitator shaft, a stator fixed to a second stationary portion of the machine to be concentric with the agitator shaft to constitute an electric motor together with the stator, and a clutch including a holder mounted on the tub shaft for rotation with the tub shaft. The clutch further includes a first engagement portion formed in a third stationary portion of the machine, a second engagement portion formed in the rotor, a lever mounted on the holder to be selectively engaged with one of the first and second engagement portions, the lever operatively coupling the rotor to the agitator shaft when engaged with the first engagement portion, the lever operatively coupling the rotor to both of the agitator and tub shafts when engaged with the second engagement portion, and toggle type springs holding the lever in engagement with the first and second engagement portions respectively.

26 Claims, 28 Drawing Sheets

FIG. 12A INDUCED VOLTAGE

FIG. 12B HALL ELEMENTS

FIG. 12C ENERGIZATION PATTERN 1

FIG. 12D ENERGIZATION PATTERN 2

FIG. 12E ENERGIZATION PATTERN 3

FIG. 17A PWM SIGNAL

FIG. 17B BRAKING CURRENT ia

FIG. 17C BRAKING CURRENT ib

FIG. 17D PWM SIGNAL

FIG. 17E BRAKING CURRENT ia

FIG. 17F BRAKING CURRENT ib

WASHING MACHINE WITH IMPROVED DRIVE STRUCTURE FOR ROTATABLE TUB AND AGITATOR

BACKGROUND OF THE INVENTION

1. Field of the Invention

This invention relates to a washing machine with an improved drive structure for driving a rotatable tub and an agitator.

2. Description of the Prior Art

Conventional fully automatic washing machines comprise a rotatable tub rotatably mounted in an outer tub and serving both as a wash tub and as a dehydration basket and an agitator mounted in the rotatable tub. A single electric motor is provided for driving both of the rotatable tub and the agitator. More specifically, in a wash step of the washing operation, a motor speed is decelerated and its rotation is transmitted only to the agitator so that the same is driven repeatedly alternately forward and backward. In a dehydration step, the motor speed is not decelerated and its rotation is transmitted both to the rotatable tub and to the agitator so that both of them are rotated at high speeds.

A rotation transmission path from the motor to the rotatable tub and the agitator includes a belt transmission mechanism and a gear reduction mechanism having planetary gears in the above-described washing machine. These belt transmission mechanism and gear reduction mechanism increase the weight and the height of the washing machine, resulting in an increase in the size thereof. Furthermore, a loud noise is produced during operation of the gear reduction mechanism. Additionally, provision of these mechanisms results in a problem of power transmission loss and requires the adjustment of belt tension.

To solve the above-described problems, the prior art has proposed a direct drive of the rotatable tub and the agitator by the motor. Motor rotation needs to be switched between the case where only the agitator is driven and the case where both of the agitator and rotatable tub are driven, as described above. In the direct drive, the structure for the switching in the transmission of motor rotation needs to be simplified and the reliability thereof needs to be improved.

SUMMARY OF THE INVENTION

Therefore, an object of the present invention is to provide a washing machine wherein the weight, the size thereof and the noise produced therein can be reduced, the structure for the switching in the transmission of motor rotation can be simplified and the reliability thereof can be improved.

To achieve the object, the present invention provides a washing machine comprising a hollow tub shaft mounted on a first stationary portion of the machine for rotation, a rotatable tub rotatably mounted on an upper end of the tub shaft, an agitator shaft concentrically inserted in the tub shaft for rotation and having upper and lower ends projecting out of the tub shaft, an agitator mounted on the upper end of the agitator shaft to be located in the rotatable tub, a stator fixed to a second stationary portion of the machine to be concentric with the agitator shaft, a rotor mounted on the lower end of the agitator shaft to constitute an electric motor together with the stator, and a clutch including a holder provided on the tub shaft for rotation with the latter. The clutch further includes a first engagement portion formed in a third stationary portion of the machine, a second engagement portion formed in the rotor, a lever provided on the holder to be selectively engaged with one of the first and second engagement portions, the lever operatively coupling the rotor to the agitator shaft when engaged with the first engagement portion, the lever operatively coupling the rotor to both of the agitator and tub shafts when engaged with the second engagement portion, the toggle type springs holding the lever in engagement with the first and second engagement portions respectively. The clutch is actuated so that the rotor of the motor is operatively coupled to the agitator shaft to thereby drive the agitator for execution of a wash step of a washing operation and so that the rotor of the motor is operatively coupled to both of the agitator and tub shafts to drive the agitator and the rotatable tub for execution of a dehydration step of the washing operation.

According to the above-described construction, the agitator shaft and accordingly the agitator are directly rotated by the motor rotor during the wash step, whereas both the tub and agitator shafts ad accordingly, both of the agitator and the rotatable tub are directly rotated by the motor rotor in the dehydration step. Thus, since a direct drive structure is provided, neither a belt transmission mechanism nor a gear reduction mechanism is required. Consequently, the weight, the size of the washing machine and noise produced in the washing machine can be reduced. Furthermore, since the clutch includes the first and second engagement portions, the holder, the lever and the toggle type springs, the construction of the clutch is simplified. The clutch is further reliable in its operation since the clutch lever is held in engagement with each engagement portion by the toggle type springs. Consequently, the present invention can provide a readily achieved direct drive structure.

The above-described rotor preferably comprise a rotor housing, an annular rotor yoke mounted on the rotor housing, and a plurality of rotor magnets mounted on the rotor housing, the rotor yoke being standardized. Consequently, the rotor can readily be assembled, and the production cost of the rotor can be reduced.

The rotor housing is preferably formed from aluminum by die-casting and a rotor yoke is preferably formed on the rotor housing by an insert molding. The rotor yoke can reliably be fixed to the rotor housing and the number of assembly steps can be reduced.

The rotor preferably includes a plurality of rotor magnets each of which constitutes one pole and each rotor magnet has opposite ends each having a reduced thickness. Consequently, a cogging torque can be reduced and accordingly, noise can be reduced.

The rotor magnets preferably have both pole chips formed with respective unsaturated magnetization portions. Consequently, the cogging torque can be reduced and accordingly, noise can be reduced.

The stator preferably includes a slotted iron core having unequal slot pitches. In this construction, too, the cogging torque can be reduced and accordingly, noise can be reduced.

The stator preferably includes a slotted iron core having teeth and the rotor preferably includes a plurality of rotor magnets. In this construction, a gap between distal ends of the stator teeth and distal ends of the rotor magnets is non-uniform. As a result, the cogging torque and accordingly, noise can be reduced.

The motor preferably comprises a brushless motor and the number of stator poles. The number of rotor poles and a maximum rotational of the brushless motor are so determined that a commutation frequency is 1 kHz or below 1 kHz or that a cogging frequency is 1 kHz or below 1 kHz. In this construction, the noise can be reduced.

The stator preferably includes an annular wound iron core formed by combining unit iron cores together and the number of the unit iron cores is obtained by dividing 360 degrees by a divisor of the number of poles of the stator. The core can efficiently assembled without reduction in the magnetic characteristics of the stator.

The stator preferably has a plurality of screw holes into which a plurality of stepped screws are screwed to thereby fix the stator on the second stationary portion and the stepped screws preferably have straight portions inserted into the screw holes respectively such that the stator is positioned. Consequently, since the stator can accurately be mounted, reductions in the motor performance can be prevented.

The stator preferably includes a laminated iron core having a plurality of concave portions, the presser plates having respective annular stepped portions holding the laminated core therebetween. Each presser plate preferably has a plurality of convex portions fitted into the concave portions of the laminated core respectively. All the laminations of the stator can be rendered concentric, furthermore, the laminated core can be positioned relative to a rotational direction of the rotor.

The rotor magnets are preferably mounted on the rotor housing each to slightly project from the rotor yoke. The washing machine further comprises position detecting means for detecting a rotational position of the rotor. The position detecting means comprises magnetic detecting elements disposed to be opposite to projected portions of the rotor magnets. In this construction, the rotational position of the rotor can be detected using the rotor magnets.

The washing machine may further comprise a motor drive circuit including a dc power supply circuit and a three-phase inverter main circuit for converting dc power to ac power, the three-phase inverter main circuit including a plurality of switching elements, and electromagnetic brake control means for controlling the switching elements of the inverter main circuit by means of a PWM control so that a motor electromotive force produces a braking current, the electromagnetic brake control means being adapted to change modes of the PWM control to thereby selectively execute an emergency stop brake control mode or a normal stop brake control mode.

According to the above-described arrangement, the tub shaft is braked by the electromagnetic brake. The braking arrangement can be simplified and rendered light-weight as compared with mechanical braking means. Furthermore, the electromagnetic brake control means changes the modes of the PWM control to execute either the emergency stop brake control mode or the normal stop brake control mode. Consequently, a braking force can readily be changed. For example, the motor and accordingly, the rotatable tub can readily be braked in the normal stop brake control mode at the time of completion of the dehydration step. The rotatable tub can also be braked in the emergency stop brake control mode immediately when an access lid is opened during the dehydrating operation.

A rotational speed of the rotatable tub is preferably prevented from being increased for a predetermined period of time after the brake control has been executed in the emergency stop brake control mode by the electromagnetic brake control means. Consequently, abnormal heating of the motor can be prevented.

The washing machine may further comprises a motor drive circuit including a dc power supply circuit and a three-phase inverter main circuit for converting dc power to ac power, the three-phase inverter main circuit including a plurality of switching elements, electromagnetic brake control means for controlling the switching elements of the inverter main circuit by means of a PWM control so that a motor electromotive force produces a braking current, temperature detecting means for detecting a temperature of an electrical component consuming a braking current, and operation control means for controlling a rotational speed of the rotatable tub in accordance with results of the temperature detection by the temperature detecting means. As the result of the above arrangement, overheating of the motor can be prevented.

The electromagnetic brake control means preferably includes switching means for switching between a case where the dc power supply circuit is connected to the inverter main circuit during a normal operation of the machine and a case where the dc power supply circuit is disconnected from the inverter main circuit and the inverter main circuit is short-circuited between both input side ends thereof with a discharge element being interposed between the input side ends during execution of the brake control or power turnoff. The discharge element can serve as a resistance consuming a braking current both when a power stoppage has occurred and when the brake has been applied.

The brake control means preferably controls the switching elements of the inverter main circuit by means of the PWM control in accordance with a difference between potentials of both ends of the discharge element. The braking current can be rendered high when being low. Thus, the braking current can be maintained at a suitable level and a stopping time can be shortened.

The braking control means may control the switching elements of the inverter main circuit by means of the PWM control in accordance with a rotational speed of the motor. When the braking current is low, it can be rendered high by the PWM control which is in accordance with the motor speed correlated with the braking current. Consequently, the braking current can also be maintained at a suitable level and the stopping time can be shortened.

Control means is preferably provided for controlling operation of the machine and supplied with power from the dc power supply circuit of the motor drive circuit. In this arrangement, the brake control means executes a braking operation when a power stoppage has occurred during the dehydration step and the dc power supply circuit is charged by means of a motor electromotive force. Consequently, since the control means can be operated normally until the rotatable tub stops, the clutch can be prevented from being switched during application of brake to the rotatable tub.

The washing machine may further comprise lever actuating means for actuating the lever of the clutch. The lever actuating means is supplied with power from the dc power supply circuit of the motor drive circuit. The lever is actuated to hold the rotatable tub in a coupled state to the motor rotor when a power stoppage has occurred during execution of the dehydrating step. Consequently, the clutch can be prevented from being switched when a power stoppage has occurred during the dehydrating operation.

The washing machine may further comprise a plurality of position detecting elements each for detecting a rotational position of the rotor, thereby generating position detection signals. The control means may have a memory storing data of a plurality of motor energization patterns determined according to the position detection signals generated by the position detecting elements. One of the energization patterns is selected in accordance with an operation mode and a rotational speed of the motor. Even a motor having a low speed characteristic an be used, and a current capacity of the inverter main circuit can be rendered small.

A duty ration in the PWM control is preferably varied when the energization pattern is switched from one to another. A sudden change in the motor speed results in noise when the energization pattern is switched. However, such noise can effectively be prevented. The same effect can also be achieved when a rotational speed control gain is adjusted during drive of the motor in each energization pattern.

The tub shaft preferably has a flat face formed on an outer circumferential surface thereof and the holder preferably has a hole into which the flat face of the shaft is fitted such that the holder is prevented from rotation. Rotation of the holder can be prevented in a simple construction.

The tub shaft may be rotatably mounted on bearing means further mounted on the first stationary portion and the bearing may be provided with pressing means for pressing the bearing means axially of the tub shaft. Noise produced by the bearing means can be prevented.

BRIEF DESCRIPTION OF THE DRAWINGS

Other objects, features and advantages of the present invention will become clear upon reviewing the following description of preferred embodiments thereof, made with reference to the accompanying drawings, in which.

DETAILED DESCRIPTION OF THE PREFERRED EMBODIMENTS

Figure 1:
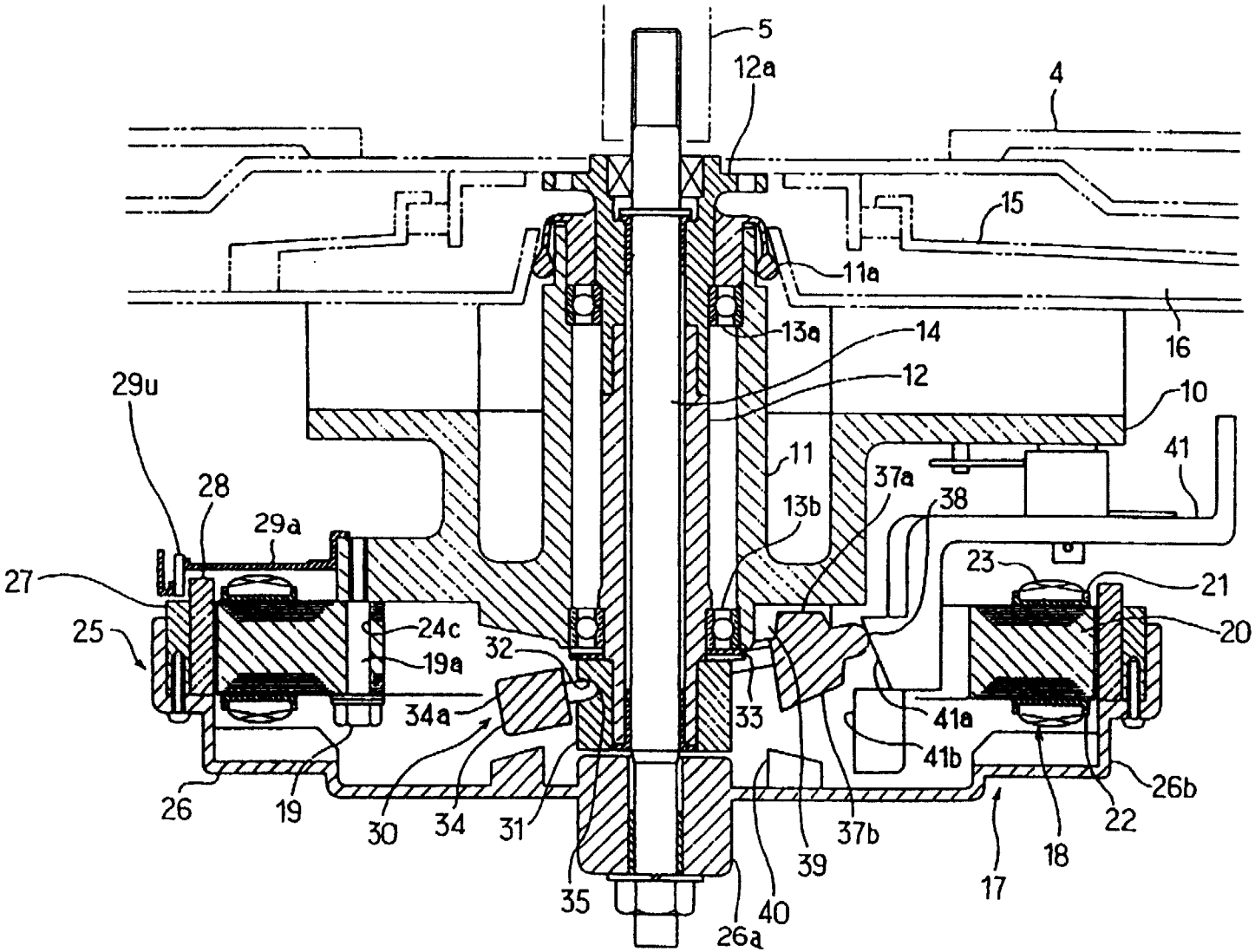
FIG. 1 is a longitudinal side section of a mechanism section of a washing machine of a first embodiment in accordance with the present invention.

A first embodiment of the present invention will be described with reference to FIGS. 1 to 19. Referring first to FIG. 2, a washing machine of the first embodiment is shown. An outer cabinet 1 encloses a water-receiving tub 2 suspended on a plurality of elastic suspension mechanisms 3 only one of which is shown. The water-receiving tub 2 serves for receiving water resulting from a dehydrating operation. A rotatable tub 4 serving both as a wash tub and as a dehydration tub is rotatably mounted in the water-receiving tub 2. An agitator 5 is rotatably mounted on the bottom of the rotatable tub 4. A drive mechanism for the rotatable tub 4 and the agitator 5 will be described later.

The rotatable tub 4 includes a tub body 4*a* formed into the shape of a gradually upwardly spreading tapered cylinder, an inner cylinder 4*b* provided inside the tub body 4*a* to define a water passing space, and a balancing ring 4*c* mounted on an upper end of the tub body 4*a*. Upon rotation of the rotatable tub 4, a resultant centrifugal force raises water therein, which is then discharged into the water-receiving tub 2 through dehydration holes (not shown) formed in the upper portion of tub 4.

The tub body 4*a* has a through hole 6 formed through the bottom thereof. A tub shaft extends through the hole 6 as will be described later. A drain hole 7 is formed in the right-hand bottom of the water-receiving tub 2, as viewed in FIG. 2. A drain valve 8 is provided in the drain hole 7. A drain hose 9 is connected to the drain hole 7. An auxiliary drain hole 7*a* is formed in the left-hand bottom of the water-receiving tub 2, as viewed in FIG. 2. The auxiliary drain hole 7*a* is connected through a connecting hose (not shown) to the drain hose 9. The auxiliary drain hole 7*a* is provided for draining water which is discharged through the dehydration holes in the upper portion of the rotatable tub 4 into the water-receiving tub 2 upon rotation of the rotatable tub 4 for the dehydration operation.

Figure 2:
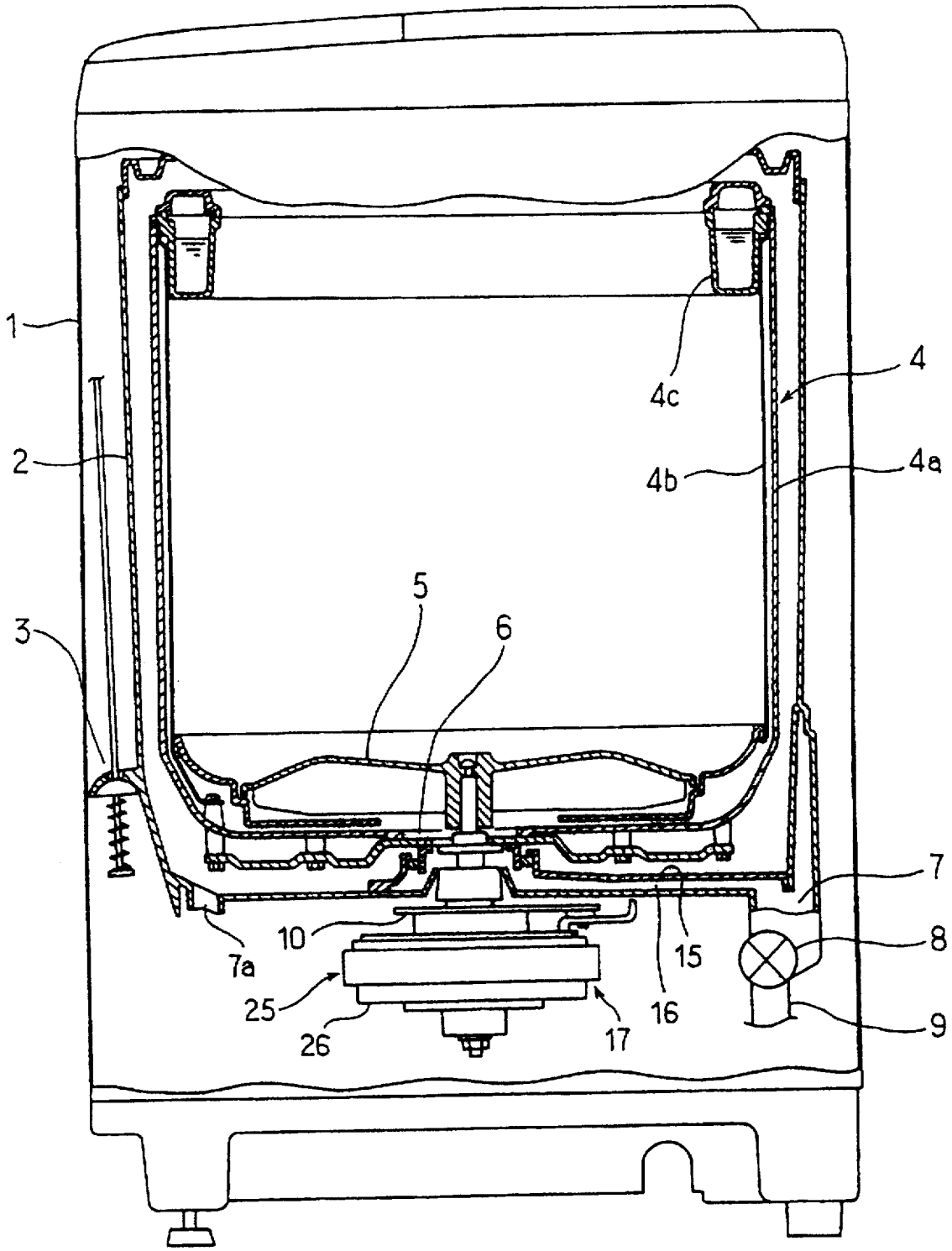
FIG. 2 is a longitudinal side section of the washing machine.

Referring to FIG. 1, a mechanism base 10 is mounted on an outer bottom of the water-receiving tub 2. The mechanism base 10 is formed in its central portion with a vertically extending shaft support cylinder 11. A hollow tub shaft 12 is inserted in the shaft support cylinder 11 to be supported on bearing members such as ball bearings 13*a* and 13*b* for rotation. A seal 11*a* is interposed between an upper end of the shaft support cylinder 11 and an outer circumferential surface of the tub shaft 12. An agitator shaft 14 is inserted in the tub shaft 12 for rotation. Upper and lower ends of the agitator shaft 14 extend out of the tub shaft 12. The tub shaft 12 has an integrally formed flange 12*a* on the upper end thereof. The rotatable tub 4 is fixed to the flange 12*a* so that the rotatable tub 4 is rotated with the tub shaft 12. The agitator 5 is fixed to the upper end of the agitator shaft 14 so as to be rotated therewith, as is shown in FIGS. 1 and 2.

A drain cover 15 extends between the central inner bottom of the water-receiving tub 2 and the drain hole 7 to define a draining passage 16 extending from the bottom of the rotatable tub 4 to the drain valve 8 of the drain hole 7, as is shown in FIGS. 1 and 2. In this construction, water is stored in the rotatable tub 4 when supplied into the tub 4 with the drain valve 8 closed. The water in the rotatable tub 4 is discharged through the hole 6, the draining passage 16, the drain hole 7, the drain valve 8, and the drain hose 9 sequentially when the drain valve 8 is opened.

Figure 3:
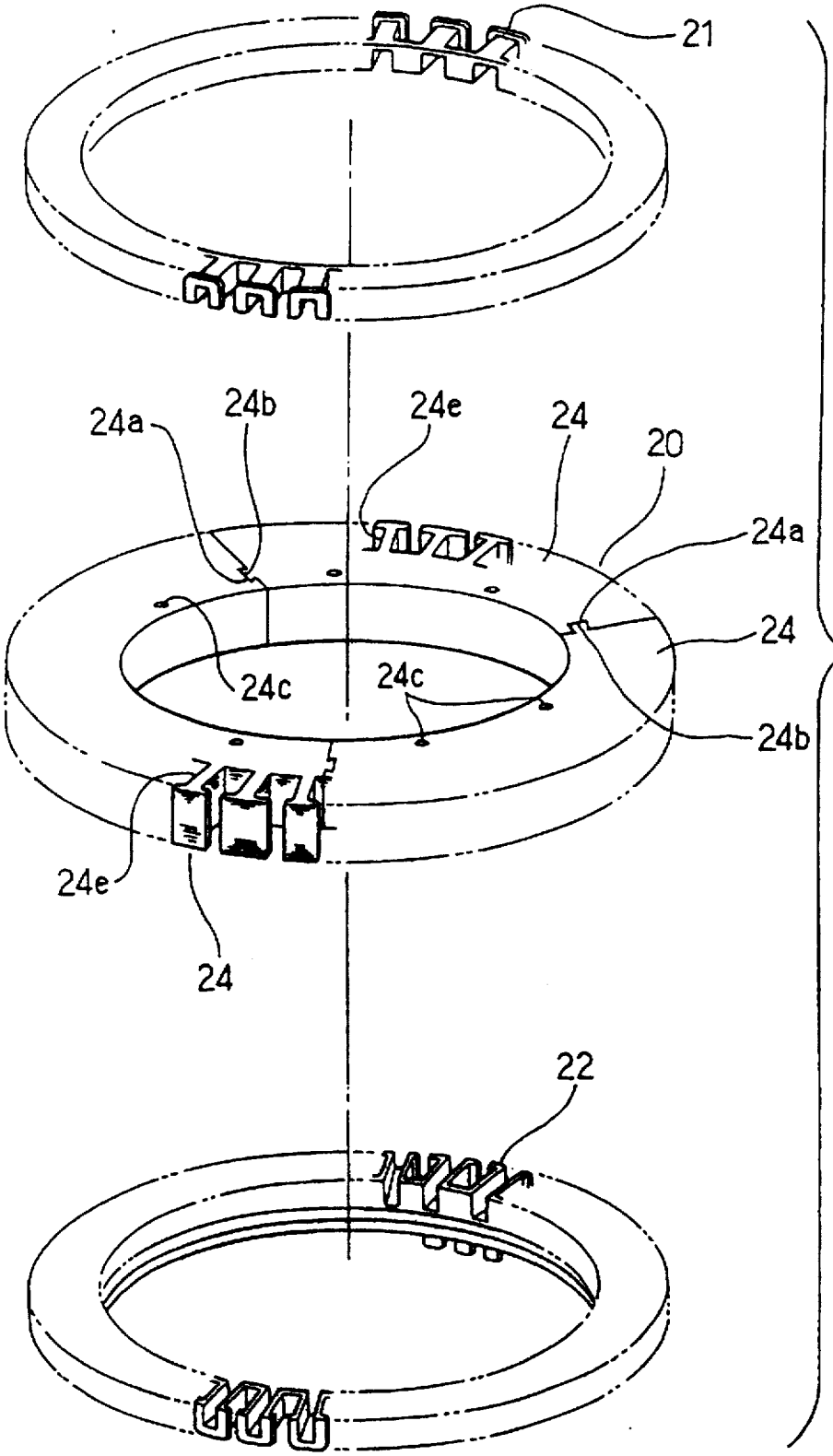
FIG. 3 is an exploded perspective view of a motor stator.
Figure 4:
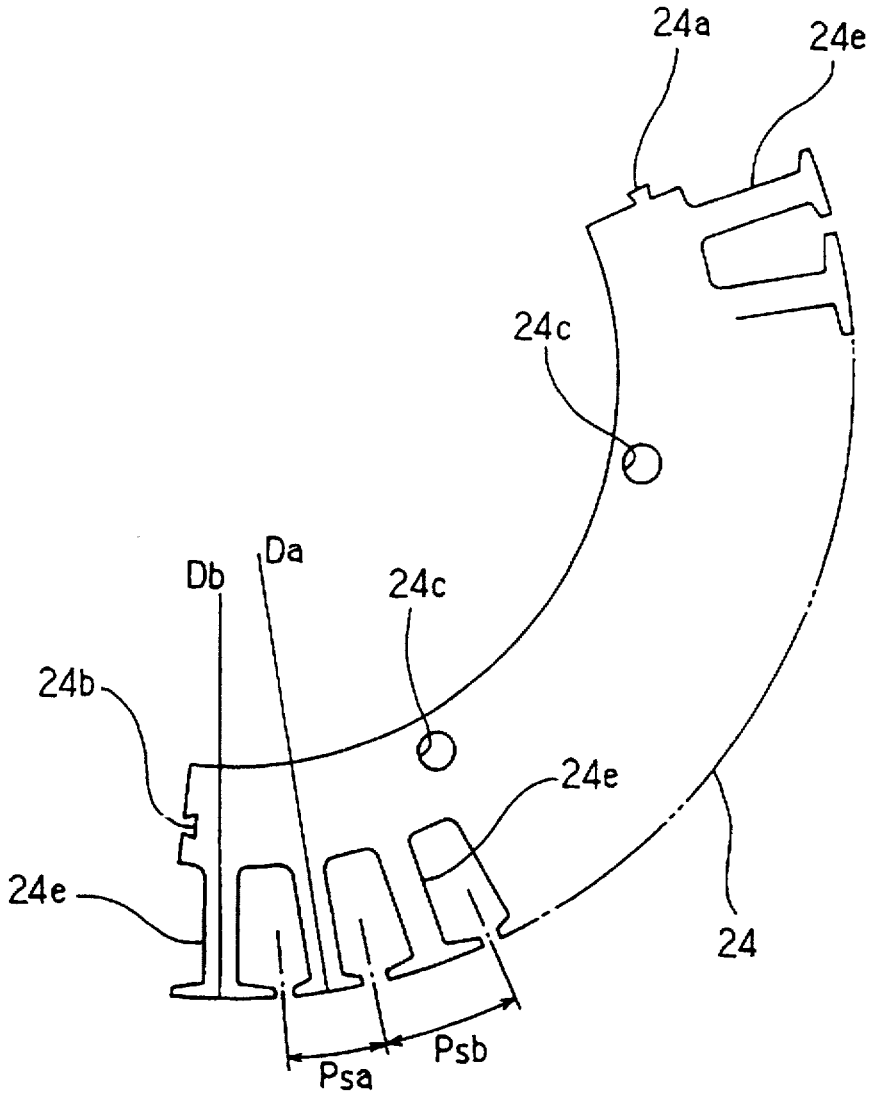
FIG. 4 is a plan view of a unit iron core.

An electric motor 17 such as an outer rotor type brushless motor wherein a rotor is located outside stator coils is mounted on the mechanism base 10 further mounted on the outer bottom of the water-receiving tub 2. More specifically, a stator 18 of the motor 17 is mounted on the mechanism base 10 by stepped screws 19 to be concentric with the agitator shaft 14. The stator 18 comprises a laminated iron core 20, upper and lower bobbins 21 and 22, and a winding 23 (see FIG. 1), as is shown in FIG. 3. The laminated iron core 20 comprises three generally circular arc-shaped unit iron cores 24 connected to one another into an annular shape, as shown in FIGS. 3 and 4. Each unit iron core 24 has engagement convex and concave portions 24*a* and 24*b* formed on both ends thereof respectively for the connection to the others. Furthermore, each unit iron core 24 has two screw holes 24*c* each having a diameter approximately equal to that of a straight portion 19*c* (see FIG. 1) of each stepped screw 19. The laminated core 20 has thirty-six slots. Slot pitches differ from every other slot as shown by reference symbols Psa and Psb in FIG. 4, that is, the widths of distal ends of teeth 24*e* differ from every other tooth. The diameter Da of each tooth 24*e* with a small distal end width is set to be larger than the diameter Db of each tooth 24*e* with a large distal end width. For example, the diameter Da is set at 226.8 mm and the diameter Db is set at 226.0 mm. As a result, a gap between an outer circumferential end of the core 20 and an inner circumferential end of a rotor 25 defined by rotor magnets 28 is rendered non-uniform as will be described later, whereby a cogging torque is reduced. The upper and lower bobbins 21 and 22 are each made of a plastic and adapted to be fitted to upper and lower teeth 24*e* of the laminated iron core 20 respectively. The winding 23 is wound around the outer peripheries of the bobbin 21 and 22.

The stator 18 constructed as described above is mounted on the mechanism base 10 by tightening the stepped screws 19 having passed through the respective screw holes 24*c* into the mechanism base 10. In this case, since the straight portions 19*a* of the stepped screws 19 are fitted in the respective screw holes 24*c*, the stator 18 is positioned with a fine positioning accuracy. If ordinary bolts should be used instead of the stepped screws 19, threaded portions of the bolts would be fitted in the respective screw holes 24*c*, whereupon the positioning accuracy would be reduced.

A rotor 25 constituting the motor 17 together with the above-described stator 18 is mounted on the lower end of the agitator shaft 14 to be rotated therewith, as is shown in FIG. 1. The rotor 25 comprises a rotor housing 26, a rotor yoke 27, and rotor magnets 28. The rotor housing 26 is made of aluminum by die casting and has a central boss portion 26*a* and an outer peripheral magnet mounting portion 26*b* including a horizontal portion and a vertical portion. The rotor yoke 27 is bonded to an inner surface of the vertical portion of the magnet mounting portion 26*b*. A piping carbon steel pipe of JIS-G-3452 (normal designation A225) is used as the rotor yoke 27, for example. Twelve rotor magnets 28 each of which is allocated to one pole are bonded to an inner surface of the rotor yoke 27. For this purpose, a moisture resistant adhesive agent is preferred in view of the rotor yoke of the motor used in a washing machine. Epoxy resin adhesives or thermosetting adhesives are suitable for the purpose. Upper ends of the rotor magnets 28 protrude upwardly above an upper end of the rotor yoke 27.

Three Hall elements (magnetic detecting elements) 29*u* are mounted on respective fixtures 29*a* which are further fixed to the mechanism base 10. One of the three Hall elements 29*u* is shown in FIG. 1. The Hall elements 29*u* serve as position detecting means for detecting a rotational position of the rotor magnets 28 of the motor 17. The Hall elements 29*u* are disposed to be opposed to portions 28*a* of the rotor magnets 28 protruding above the upper end of the rotor yoke 27.

Figure 10:
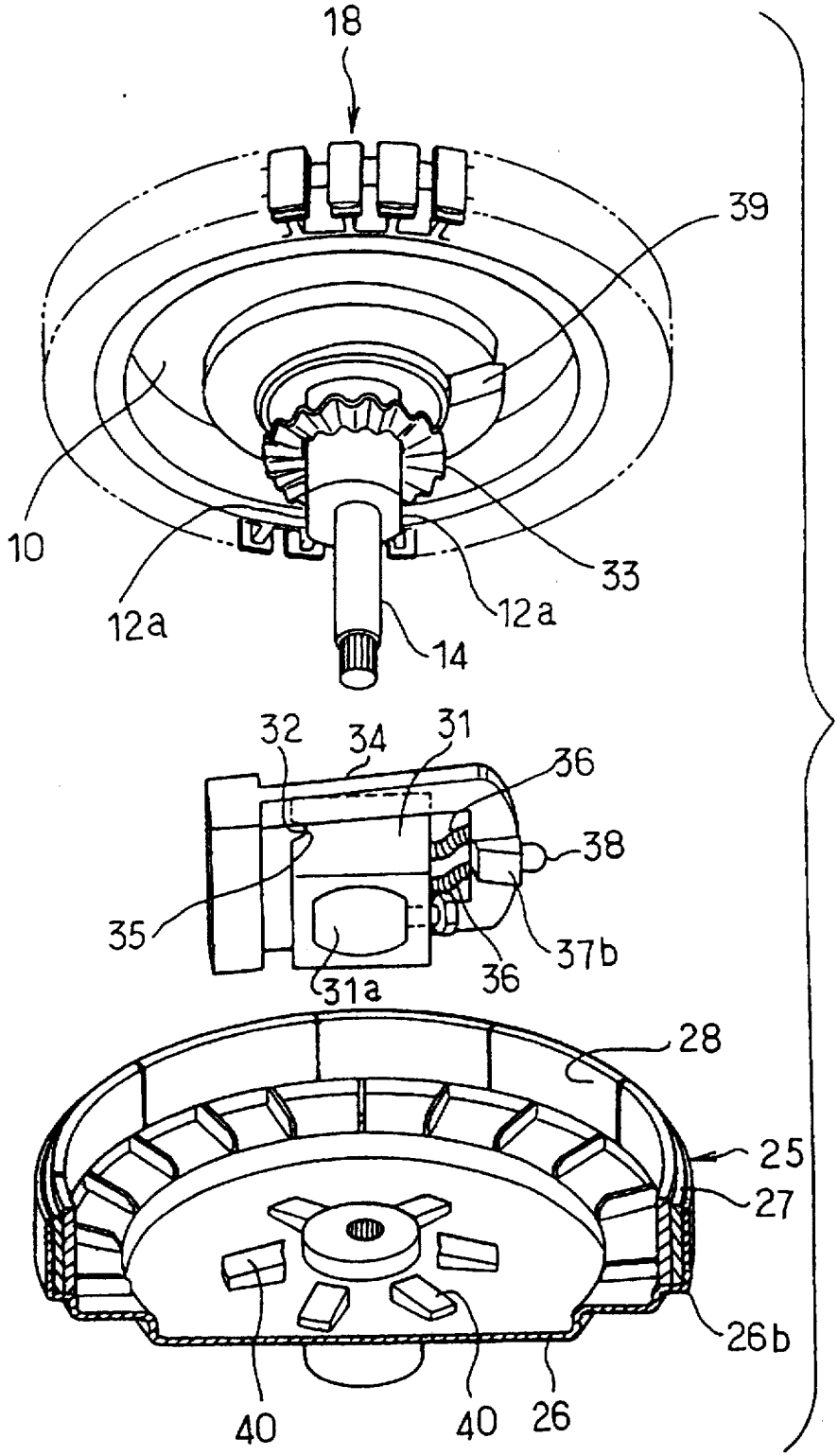
FIG. 10 is an exploded perspective view of the mechanism section.

A clutch 30 is provided on the lower end of the mechanism base 10. The clutch 30 includes a holder 31 provided on the lower end of the tub shaft 12 for rotation with the tub shaft. More specifically, the tub shaft 12 has two flat faces 12*b* formed on a lower outer circumferential surface thereof to be opposed to each other, as shown in FIG. 10. The holder 31 has a central fitting hole 31*a* having inner surfaces against which the flat faces 12*b* of the tub shaft 12 are abutted. The holder 31 further has a pivot concave portion 32 formed in the left-hand outer surface thereof to have an approximately semicircular section, as viewed in FIG. 10. Furthermore, the tub shaft 12 is provided with a corrugated washer 33 serving as pressing means. The washer 33 is located between the holder 31 and the lower bearing 13*b*. The corrugated washer 33 is adapted to press the lower bearing 13*b* axially of the tub shaft 12 or upwardly in the embodiment.

Figure 5:
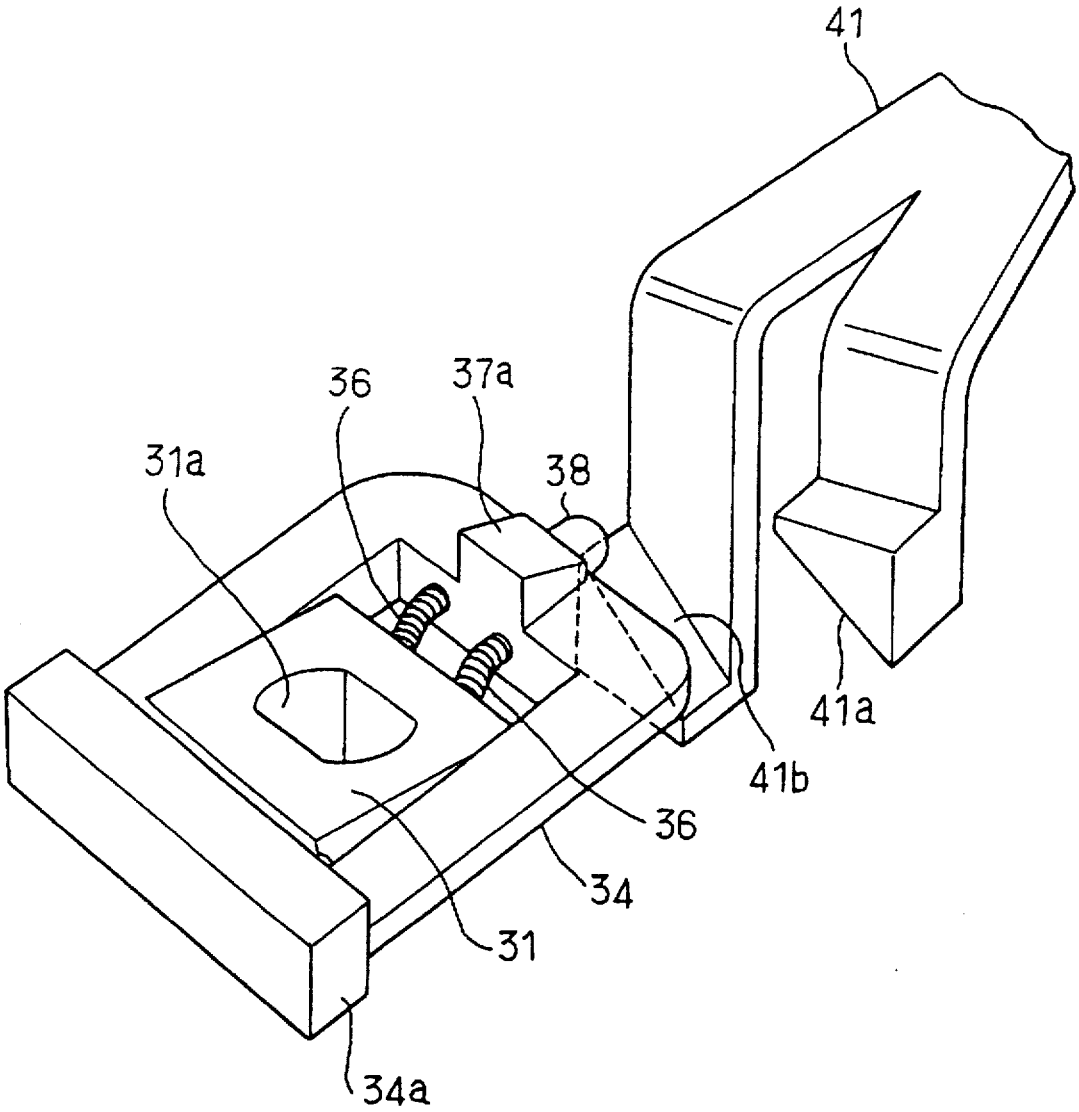
FIG. 5 is a perspective view of a clutch and a control lever.

The clutch 30 further includes a generally rectangular frame-shaped lever 34, as shown in FIG. 5. The lever 34 is fitted with the holder 31 so as to be rotated therewith. The lever 34 has in the inside of a proximal end 34*a* thereof (a left-hand end in FIG. 5) a pivot convex portion 35, as shown in FIG. 10. The pivot convex portion 35 is fitted into the pivot concave portion 32 of the holder 31 so that the lever 34 is pivotable or rotatable upwardly and downwardly about the portion 35.

Two toggle type springs 36 each comprising a compression coil spring are provided between the holder 31 and the lever 34, as are shown in FIGS. 5 and 10. The toggle type springs 36 hold the lever 34 at an upper position (see FIG. 1) when the same is rotated upwardly and at a lower position (see FIG. 6) when the same is rotated downwardly. The lever 34 has convex portions 37*a* and 37*b* formed on the upper and lower portions of an end thereof (a right-hand end as viewed in FIG. 10) respectively and an operated portion 38 protruding from an outside surface of the end.

The mechanism base 10 serving as a stationary portion has a first concave engagement portion 39 which is formed in the underside thereof so as to correspond to the upper convex portion 37*a*. The rotor housing 26 has a plurality of second convex engagement portions 40 which are formed on the upper face thereof so as to be lined along a rotational trajectory of the lower convex portion 37*b* of the lever 34.

Figure 6:
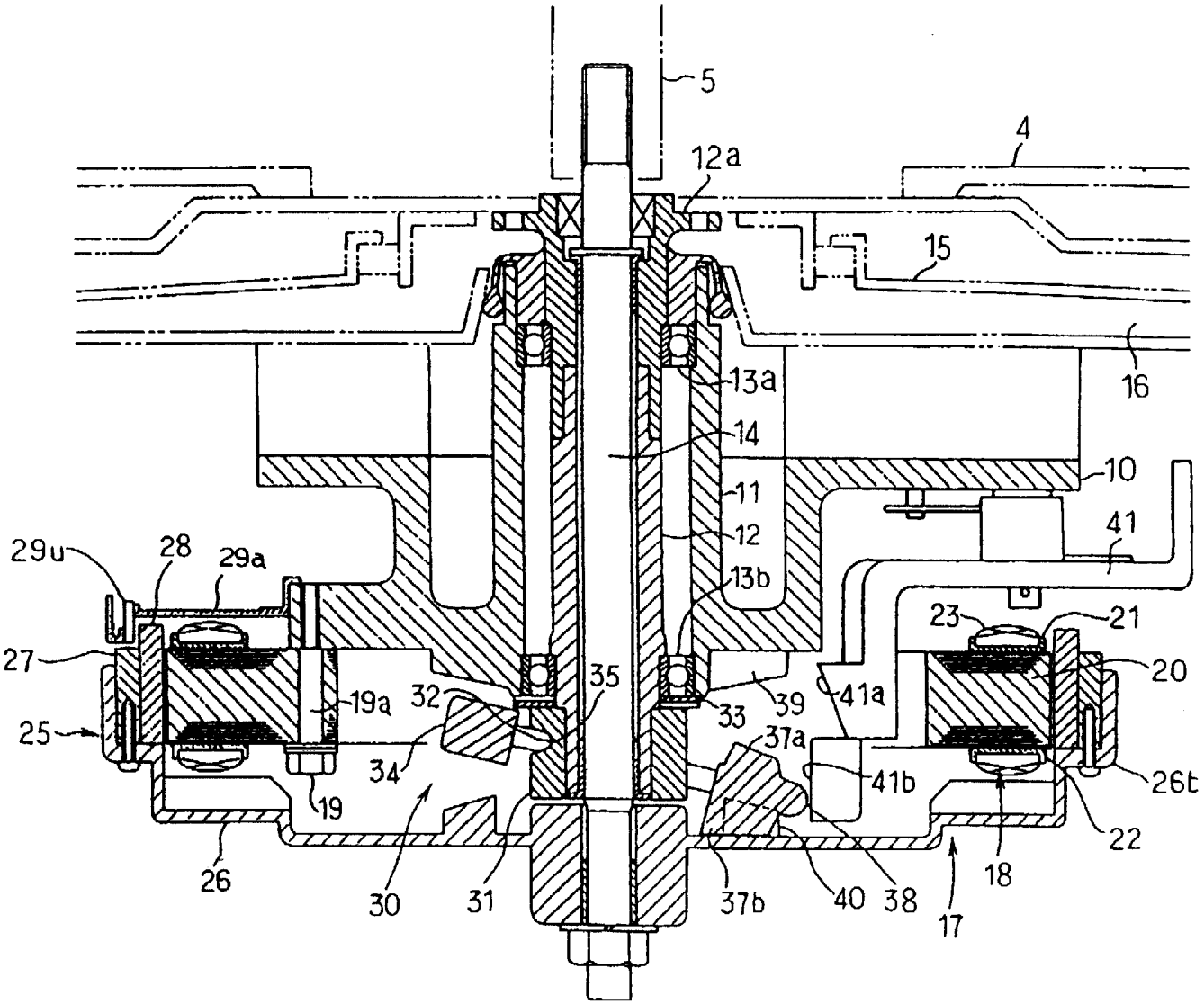
FIG. 6 is a longitudinal side section of the mechanism section with the clutch in a mode different from that in FIG. 1.

On one hand, the tub shaft 12 is decoupled from the agitator shaft 14 so as not to be co-rotated with the latter and the motor rotor 25 during wash and rinse steps of the washing operation when the upper convex portion 37*a* is engaged with the first engagement portion 39, as shown in FIG. 1. The agitator shaft 14 and the motor rotor 25 are originally coupled to each other to be rotated together. On the other hand, the tub shaft 12 is coupled with the agitator shaft 14 so as to be co-rotated with the latter and the rotor 25 during a dehydration step of the washing operation when the lower convex portion 37*b* of the lever 34 is engaged with two of the convex portions 40*b* on the upper face of the rotor housing 26, as is shown in FIG. 6.

Figure 7:
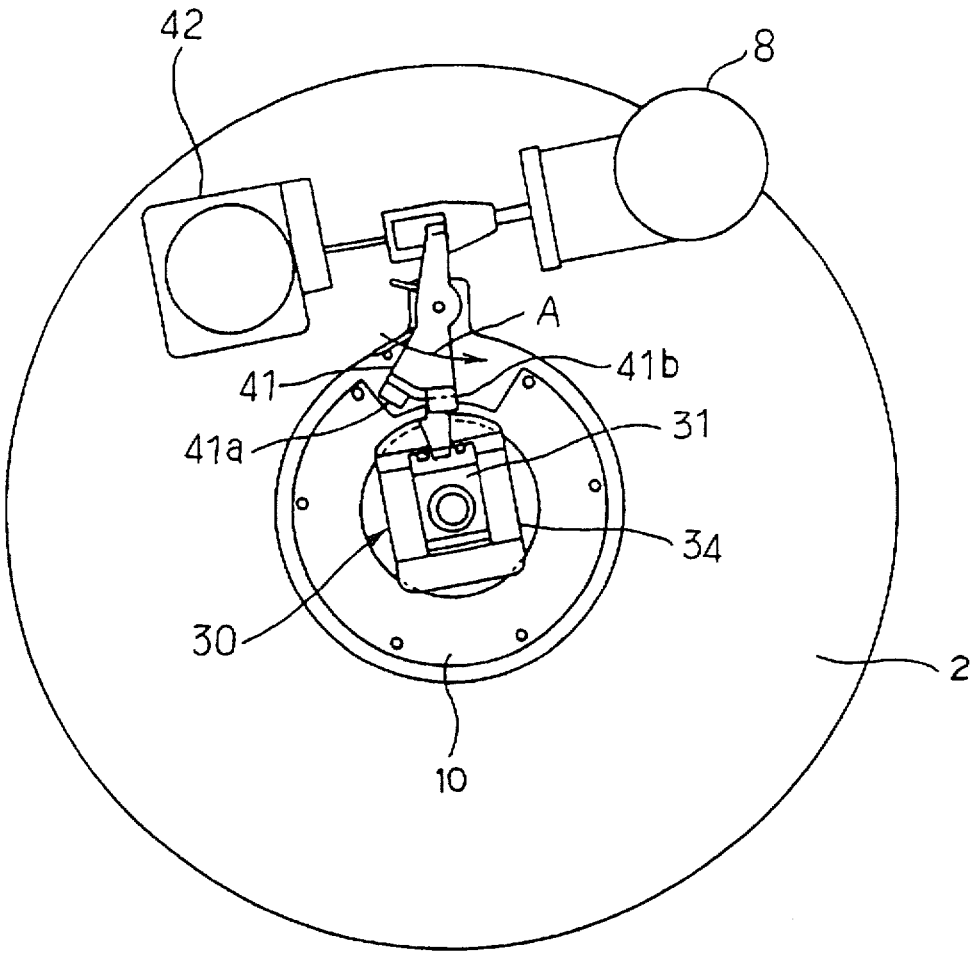
FIG. 7 is a bottom view of a water-receiving tub, showing the clutch in an operating condition.
Figure 8:
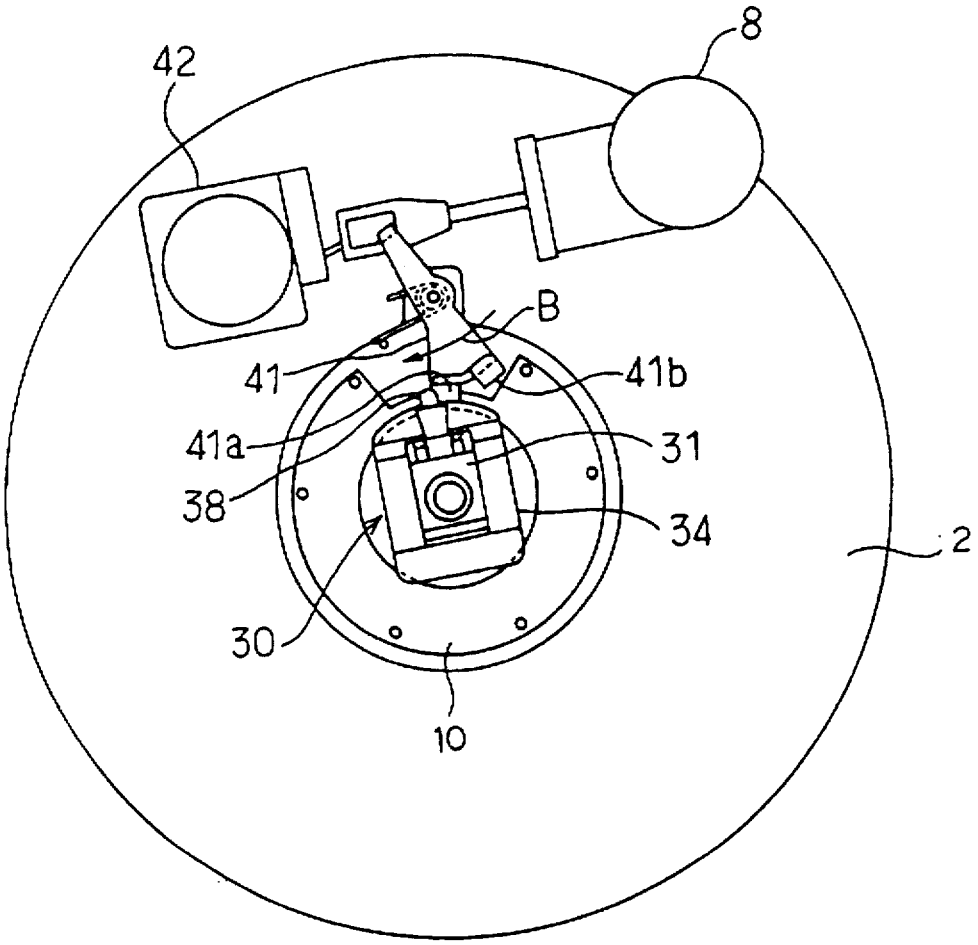
FIG. 8 is a view similar to FIG. 7, showing the clutch in another operating condition.
Figure 9:
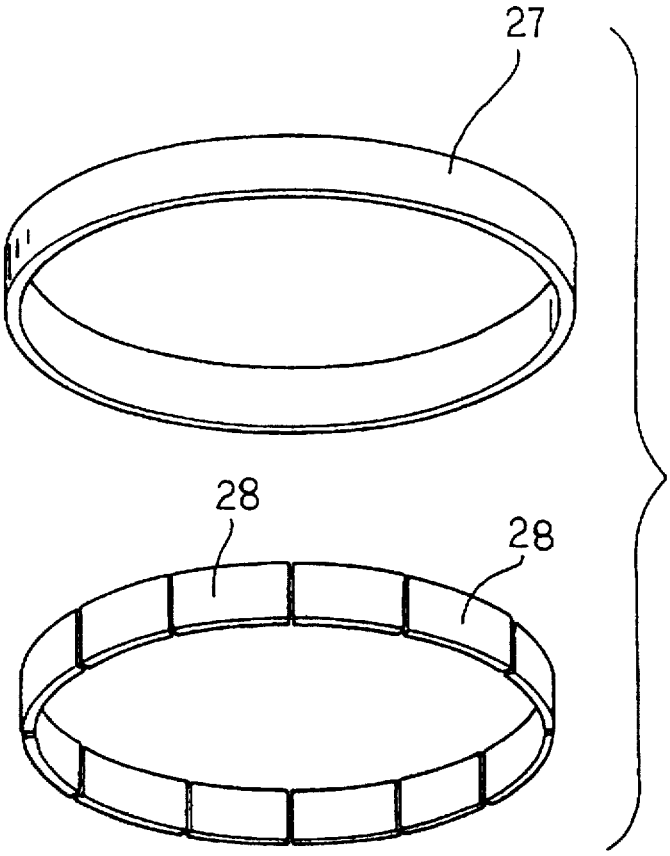
FIG. 9 is an exploded perspective view of a rotor yoke and rotor magnets.

A control lever 41 is mounted on an intermediate shaft further mounted on the mechanism base 10 so as to be pivotable, as shown in FIG. 1. The control lever 41 is caused to pivot in the direction of arrow A in FIG. 7 and in the opposite direction of arrow B in FIG. 8 upon energization of a geared motor or clutch control motor 42 serving as lever actuating means. When the control lever 41 is caused to pivot in the direction of arrow A in the condition as shown in FIG. 7, the operated portion 38 of the lever 34 is downwardly pushed by a guide portion 41*a* of the control lever 41 such that the lever 34 is rotated downwardly into the condition as shown in FIGS. 6 and 8. When the control lever 41 is caused to pivot in the direction of arrow B in the condition as shown in FIGS. 6 and 8, the operated portion 38 of the lever 34 is upwardly pushed by a guide portion 41*b* of the control lever 41 such that the lever 34 is upwardly rotated into the condition as shown in FIGS. 1 and 7. The drain valve 8 is opened when the control lever 41 assumes the position as shown in FIGS. 6 and 8, which position corresponds to the dehydration step.

As obvious from the foregoing, on one hand, the lever 34 of the clutch 30 is upwardly rotated in the wash or rinse step of the washing operation so that the agitator shaft 14 and accordingly, the agitator 5 are directly driven by the rotor 25 of the motor 17. On the other hand, the lever 34 of the clutch 30 is downwardly rotated in the dehydration step of the washing operation so that both of the agitator and tub shafts 14 and 12 and accordingly, both of the agitator 5 and the rotatable tub 4 are directly rotated. Since a direct drive structure is thus provided, reductions in the weight and size of the washing machine and noise produced therein can be achieved. Furthermore, the clutch 30 has a simple construction, and the clutch 30 is held in each of the two working conditions by the toggle type springs 36. Consequently, the reliability of operation of the clutch 30 can be improved.

Figure 11:
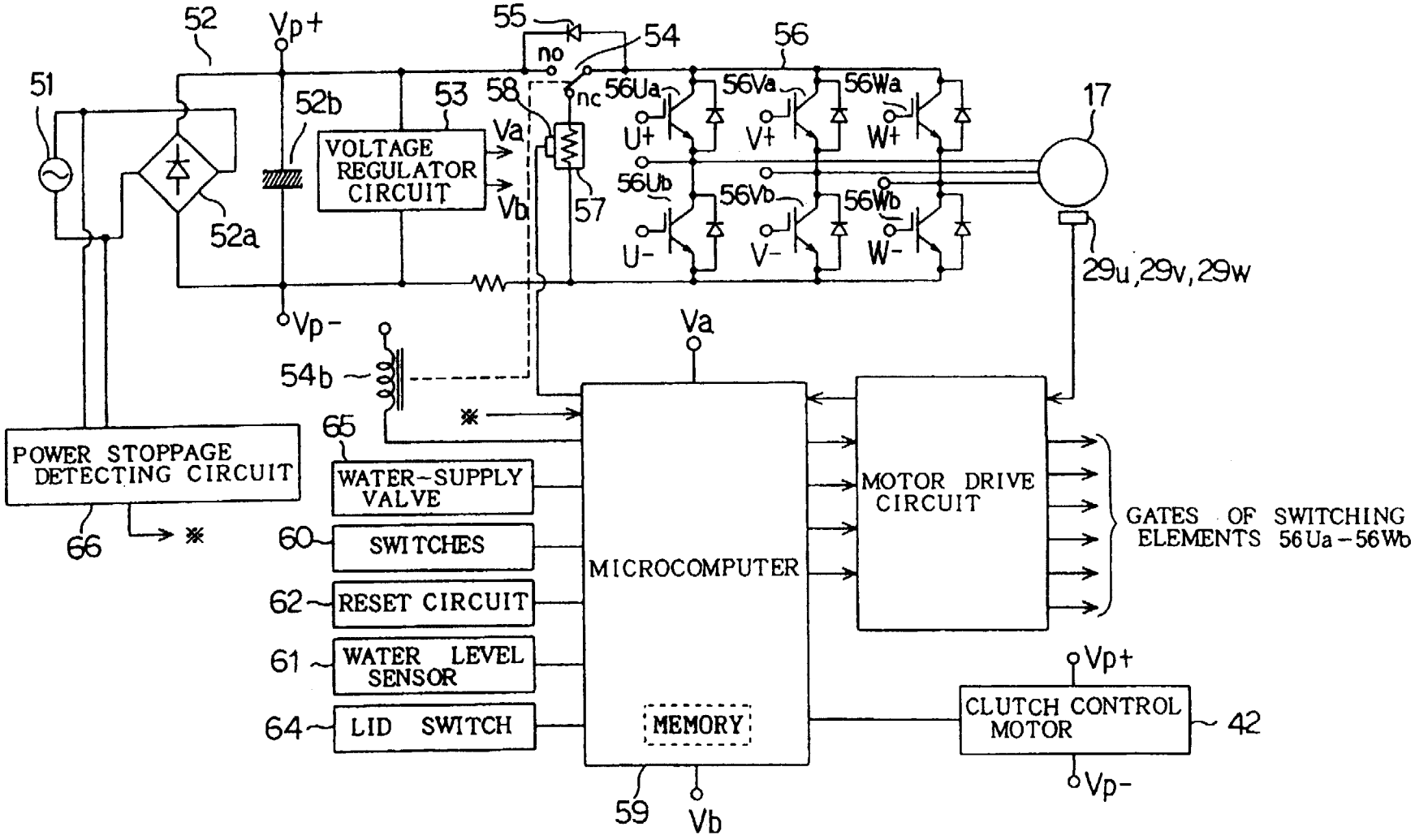
FIG. 11 is a circuit diagram showing an electrical arrangement of the washing machine.
Figure 12:
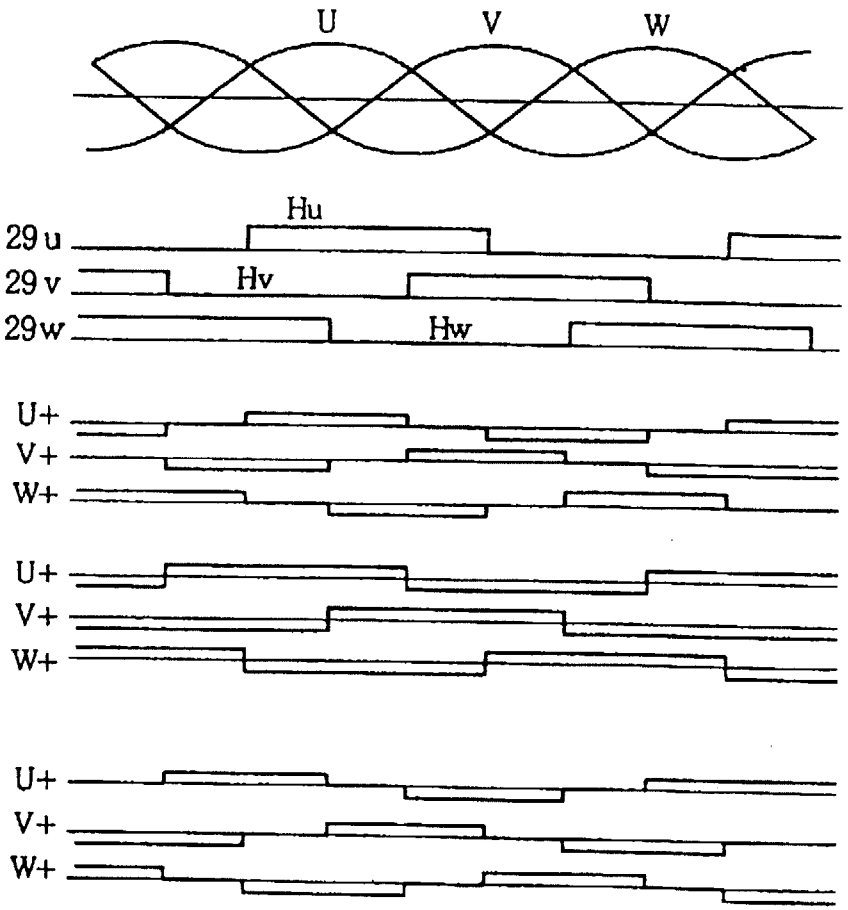
FIGS. 12A to 12E are waveform charts for explaining energization patterns.

FIG. 11 illustrates an electrical arrangement of the above-described washing machine. A dc power supply circuit 52 is connected to a commercial ac power supply 51. The dc power supply circuit 52 includes a full-wave rectifier circuit 52*a* and a smoothing capacitor 52*b*. A voltage regulator circuit 53 is connected to the output side of the dc power supply circuit 52. A three-phase inverter main circuit 56 is also connected to the output side of the dc power supply circuit 52 through a relay switch 54 serving as switching means and a diode 55 having the polarity shown on the circuit diagram. The inverter main circuit 56 includes bridge-connected switching elements 56U*a*, 56U*b*, 56V*a*, 56V*b*, 56W*a* and 56W*b* comprising insulated bipolar transistors (IGBTs), for example.

The relay switch 54 closes contacts c and nc and opens contacts c and no when a relay coil 54*a* is deenergized. The relay switch 54 opens the contacts c and nc and closes the contacts c and no when the relay coil 54*a* is energized. The contact c is connected to a positive input terminal of the inverter main circuit 56, and the contact no is connected to a positive output terminal of the dc power supply circuit 52. The contact nc is connected to a negative input terminal of the inverter main circuit 56 through a discharge resistance 57 which is a component consuming a braking current. The diode 55 is parallel connected between the contacts c and no. The discharge resistance 57 is provided with a thermistor 58 serving as temperature detecting means for detecting a temperature of the resistance 57. In the above-described circuit arrangement, the clutch control motor 42 is supplied with electric power from the dc power supply circuit 52. Control means for controlling the washing operation of the machine, such as a microcomputer 59, is supplied with electric power from the voltage regulator circuit 53 provided at the output side of the dc power supply circuit 52.

The microcomputer 59 is adapted to receive switch signals from various switches mounted in an operation panel (not shown), a detection signal from a water level sensor 61, a reset signal from a reset circuit 62, a detection signal from the thermistor 58, and motor speed detection signals from the Hall elements 29*u*, 29*v* and 29*w* through the motor drive circuit 63. The microcomputer 59 is further supplied with a signal from a lid switch 64 for detecting opening and closure of an access lid (not shown) to the rotatable tub 4. Based on these input signals, the microcomputer 59 controls the motor drive circuit 63, the clutch control motor 42, a water-supply valve 65 and so on in accordance with an operation program stored therein. Based on a control signal from the microcomputer 59, the motor drive circuit 63 executes on-off control for the switching elements 56U*a*, 56U*b*, 56V*a*, 56V*b*, 56W*a* and 56W*b* by means of pulse width modulation (PWM). This control manner will be referred to as "PWM control." A power stoppage detecting circuit 66 is connected to the ac power supply 51 for detecting power stoppage, thereby delivering a power stoppage detection signal to the microcomputer 59.

The microcomputer 59 deenergizes the clutch control motor 42 during the wash step so that the clutch 30 assumes the condition shown in FIG. 1, whereupon the agitator shaft 14 and accordingly, the agitator 5 are directly driven by the rotor 25 of the motor 17. The microcomputer 59 further energizes the clutch control motor 42 during the dehydration step so that the clutch 30 assumes the condition shown in FIG. 6, whereupon the tub and agitator shafts 12 and 14 and accordingly, the rotatable tub 4 and agitator 5 are directly driven by the rotor 25 of the motor 17. Furthermore, the relay coil 54*a* is also energized to close the contacts c and no when the motor 17 is energized.

The microcomputer 59 also executes the following control for drive of the motor 17 and so on. The microcomputer 59 is incorporated with a memory for storing data of energization patterns 1, 2 and 3 for the motor 17. FIGS. 12C to 12E illustrate these energization patterns. The phase Hall elements 29*u*, 29*v* and 29*w* output position detection signals Hu, Hv and Hw respectively when rotation of the rotor 25 causes induced voltages in the respective phases. Energization timings for the phases U, V and W of the motor 17 differ as shown by the energization patterns 1, 2 and 3 depending upon output timings of the position detection signals Hu, Hv and Hw. The switching elements 56U*a*, 56U*b*, 56 V*a*, 56V*b*, 56W*a* and 56W*b* are turned on and off (the PWM control) so that the energization patterns 1, 2 and 3 are obtained. A period of energization of each phase is set according to a target motor speed and so on. The switching elements are controlled during the energization period with a predetermined duty ratio being set. In this case, the duty ratio is successively increased in each of the energization patterns.

The energization patterns 1, 2 and 3 are selected according to an operation mode. More specifically, the energization pattern 1 is selected for the wash step in which the agitator 5 is rotated in the forward and reverse directions at low speeds and for the dehydration step. The energization pattern 1 is switched to the energization pattern 2 in a case where a target dehydrating rotational speed is not reached during the dehydration step even when the duty ratio becomes 100% under the energization pattern 1. The energization pattern 2 is switched to the energization pattern 3 in a case where the target dehydrating rotational speed is not reached during the dehydration step even when the duty ratio becomes 100% under the energization pattern 2.

Figure 13:
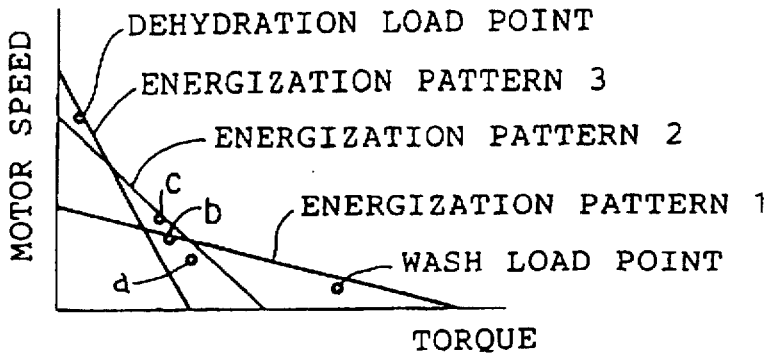
FIG. 13 is a graph showing the relationship among motor speed, torque and duty ratio.
Figure 14:
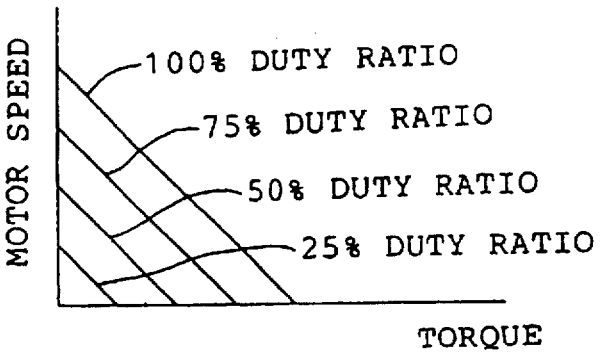
FIG. 14 is a graph showing the relationship among motor speed, torque and duty ratio.

The purport of the above-described control manners is as follows. The wash step applies a large load torque to the motor 17 and requires a long operation period. Accordingly, more efficient and therefore, less current consuming pattern 1 is selected for the wash step. The energization pattern 1 is also selected for the dehydrating step in which a large torque is required since clothes contain water, particularly, at an initial stage thereof. The energization pattern 1 is switched to the energization pattern 2 for increase of the dehydrating rotational speed when the rotational speed is low under the energization pattern 1. Furthermore, the energization pattern 2 is switched to the energization pattern 3 for increase of the dehydrating rotational speed when the rotational speed is low under the energization pattern 2. FIG. 13 shows the relationship between motor speed and torque.

Figure 30:
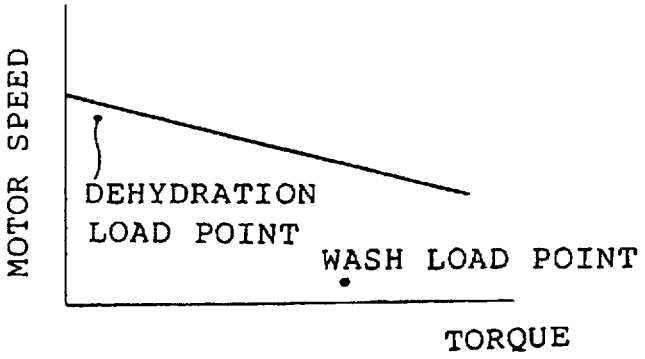
FIG. 30 is a graph of the relationship between motor speed and torque, showing the case where the energization pattern is univocal.

The energization pattern is successively switched from one to another when the load torque is small during the dehydration step, whereupon even a motor having a low speed characteristic can be used for the dehydrating operation. FIG. 30 shows the relationship between motor speed and torque in the case where the energization pattern is univocal. In the embodiment, however, the motor specifications can be relaxed as in the motor characteristics shown by the energization pattern 1 in FIG. 12C. Consequently, an amount of current at the wash load point can be reduced when the motor 17 is designed to have an equal motor efficiency at the wash load point to that of the conventional motor.

In the prior art, the duty ratio is reduced at the wash load point in the PWM control so that a low voltage is applied to the motor. However, since the motor characteristics can be varied as described above in the embodiment, the duty ratio in the PWM control can be increased. Consequently, the current capacity of the inverter main circuit 56 can be reduced and accordingly, the cost of the washing machine can be reduced. The motor efficiency is lowered in each of the above-described energization patterns 2 and 3. However, since each of these patterns is used when the load torque is small, the motor can be driven within the range of of current capacity of the inverter main circuit 56.

The microcomputer 59 changes the duty ratio in the PWM control when the energization patterns 1–3 are switched from one to another. More specifically, assume that the dehydration load varies from load point a to load point b in FIG. 13. The energization pattern 1 is selected at load point b for the drive of the motor. The motor speed is not increased even when the duty ratio becomes 100%. Subsequently, the energization pattern 1 is switched to the energization pattern 2. In this case, the dehydration load suddenly changes from load point b to the load point c when the pattern 1 is switched to the pattern 2 with the duty ratio maintained at 100%. A resultant sudden increase in the motor speed causes vibratory noise. This poses a problem.

To solve the above problem, the embodiment provides a control manner in which the duty ratio is successively increased. More specifically, the relationship among the rotational speed N of motor 17, torque T and duty ratio D is shown by the following expression (1):

$$N=D\times N_0-(N_0/T_0)T \tag{1}$$

where $N_0$ is no load rotational speed and $T_0$ is maximum torque. The microcomputer 59 stores data of no load rotational speeds and maximum torques $N_1$, $T_1$, $N_2$, $T_2$, $N_3$ and $T_3$ in the respective energization patterns 1–3. The microcomputer 59 carries out the following calculation when the energization patterns are switched from one to another. The energization pattern 1 is switched to the energization pattern 2 at load point b. The duty ratio D is 100% or 1 under the energization pattern 1. The torque Td in this case is calculated. Transforming the above expression (1), the following expression (2) is obtained:

$$\begin{aligned} T_d &= (D\times N_1-N_d)/(N_1/T_1) \\ &= (N_1-N_d)/(N_1/T_1) \end{aligned} \tag{2}$$

where $N_d$ is detected rotational speed. The duty ratio $D_c$ to be subsequently applied is then calculated:

$$D_c=(N_d+(N_2/T_2)T_d)/N_2. \tag{3}$$

The obtained duty ratio $D_c$ is applied to the motor drive circuit 63. As a result, the load point b is maintained without variation in the motor speed immediately after the switching of the energization patterns at load point b.

Furthermore, the microcomputer 59 is designed to adjust a gain in the rotational speed control of the motor 17. The duty ratio D to be subsequently applied is obtained by the following expression (4)

$$D=D-K(N_c-N_d) \tag{4}$$

where K is gain and $N_c$ is target rotational speed. The gain K is experimentally determined for each of the wash and dehydration steps, and the microcomputer 59 stores data of these gains.

Figure 15:
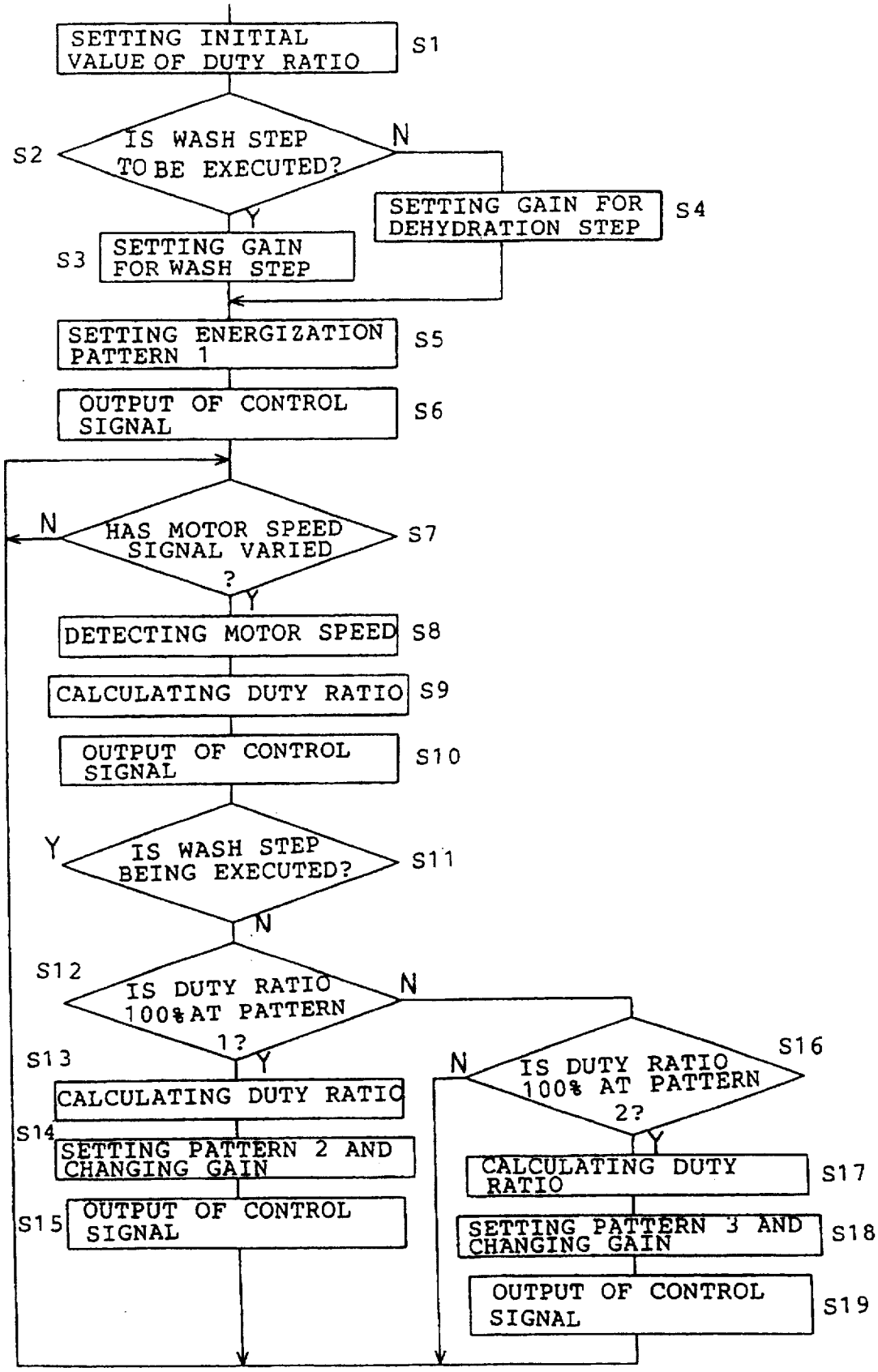
FIG. 15 is a flowchart showing the control contents of a microcomputer.
Figure 16:
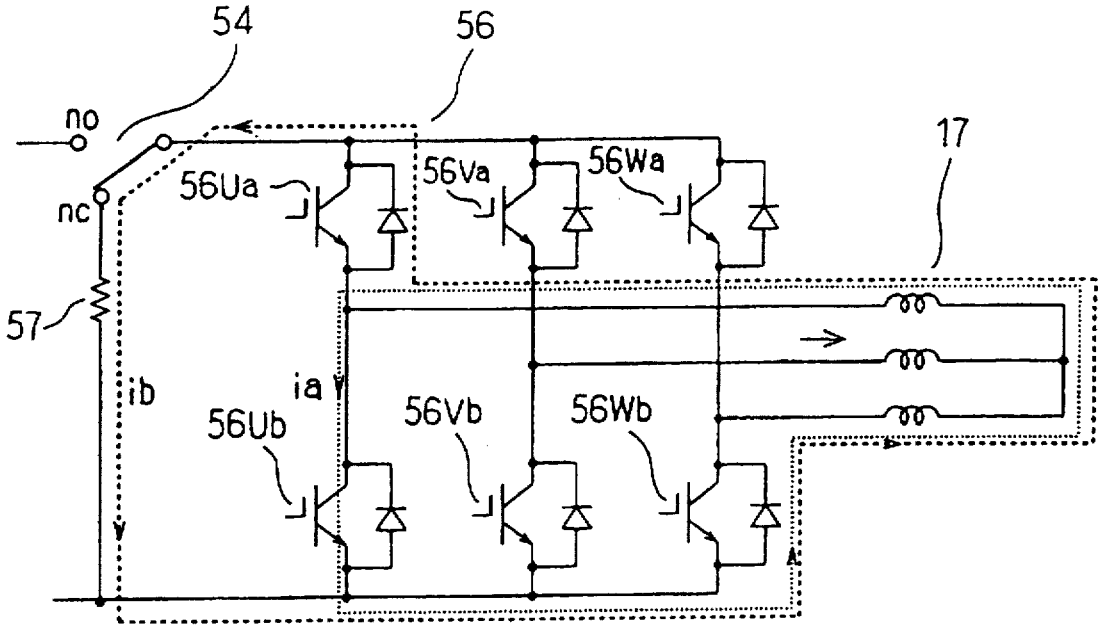
FIG. 16 is a partial circuit diagram showing flow of braking currents.
Figure 17:
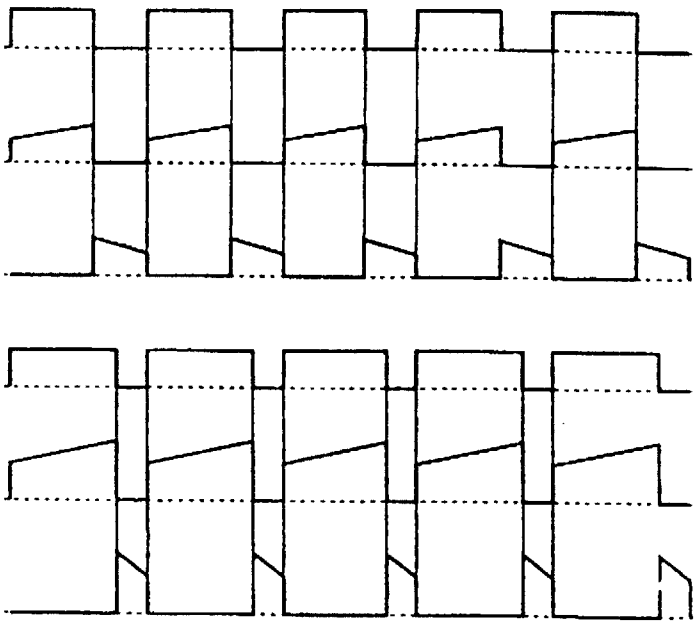
FIGS. 17A to 17F are waveform charts of PWM signals nd braking currents.

FIG. 15 is a flowchart showing the above-described control manner. An initial value of duty ratio is set at step S1. The microcomputer 59 determines which one of the wash and dehydration steps is to be executed, at step S2. The gain is set in accordance with the determined step at steps S3 or S4. Subsequently, the microcomputer 59 selects the energization pattern 1 at step S5 and delivers a control signal to the motor drive circuit 63 at step S6.

The microcomputer 59 determines whether a rotational speed detection signal has varied, at step S7. When the signal has varied, the microcomputer 59 detect the rotational speed of the motor at step S8 and calculates the duty ratio at step S9. The microcomputer 59 delivers a control signal in accordance with the obtained duty ratio to the motor drive circuit 63, at step S10. When the wash step is under execution (determination at step S11), the microcomputer 59 returns to step S7. On the other hand, when the dehydration step is under execution, the microcomputer 59 advances to step S12, determining whether the duty ratio of 100% has been reached under the energization pattern 1. When the duty ratio of 100% has been reached, the duty ratio is calculated at step S13. Furthermore, the energization pattern 1 is switched to the energization pattern 2 and the gain is varied at step S14. Control signals representative of the pattern 2 and the varied gain are delivered to the motor drive circuit 63 at step S15.

The microcomputer 59 advances to step S16 when determining at step S12 that the duty ratio of 100% has not been reached. The microcomputer 59 determines whether the duty ratio of 100% has been reached under the energization pattern 2, at step S16. When the duty ratio of 100% has been reached, the microcomputer 59 calculates the duty ratio at step S17. Furthermore, the energization pattern 2 is switched to the energization pattern 3 and the gain is varied, at step S18. The control signals representative of the pattern 3 and the varied gain are delivered to the motor drive circuit 63 at step S19.

Figure 18:
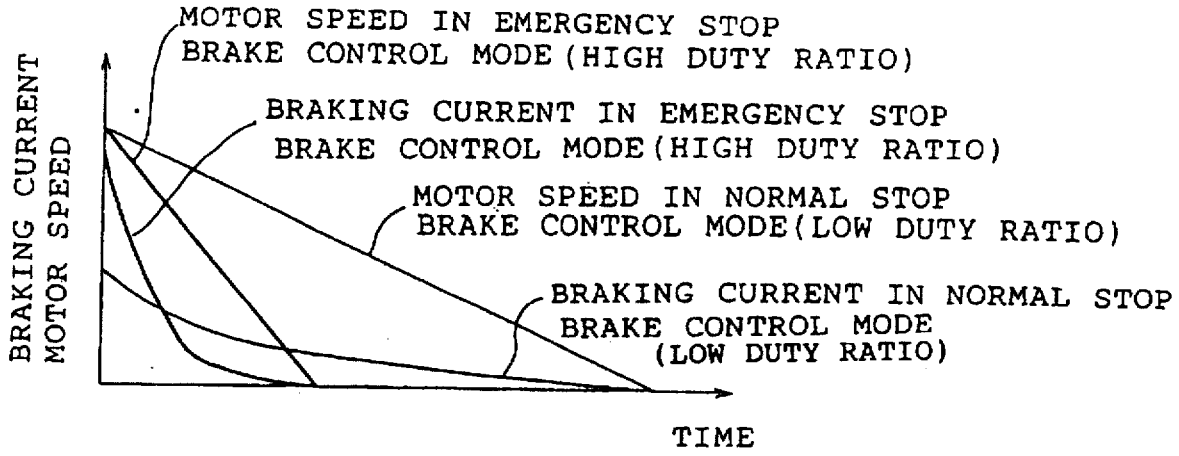
FIG. 18 is a graph showing variations in motor speeds and braking currents.
Figure 19:
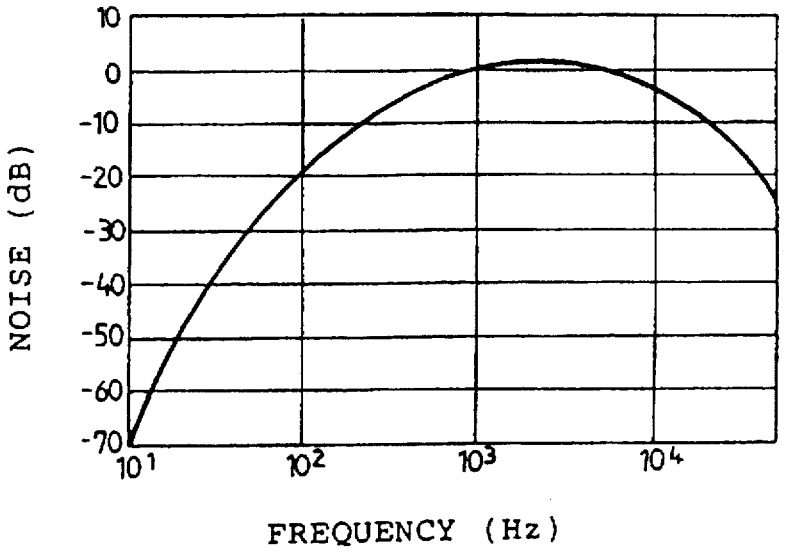
FIG. 19 is a graph showing the relationship between noise and commutation frequency.

The microcomputer 59 further has a function of electromagnetic brake control means. The rotatable tub 4 is braked when the dehydration step has been completed or when the access lid has been opened. The microcomputer 59 deenergizes the relay coil 54*a* to return the relay switch 55 to its ordinary state when the rotatable tub 4 is to be braked. The microcomputer 59 then delivers a PWM signal (gate signal) shown in FIGS. 17A or 17D to the gates of the lower stage switching elements 56U*b*, 56V*b* and 56W*b*. A braking current flows through a path shown by reference symbol ia in FIG. 16 during an "on" period of each of the switching elements 56U*b*, 56V*b* and 56W*b*. The braking current further flows through a path shown by reference symbol ib in FIG. 16 during an "off" period of each of the switching elements 56U*b*, 56V*b* and 56W*b*, and in this case, the braking current flows through the discharge resistance 57. The braking current and a stop time depend upon the rotational speed of the motor and discharge resistance value. An amount of braking current flowing through the path ia is decreased when the duty ratio in the PWM control is lowered. This braking mode is referred to as "normal stop brake control mode." The amount of braking current flowing through the path ia is increased when the duty ratio in the PWM control is increased. This braking mode is referred to as "emergency stop brake control mode." FIG. 18 shows changes in the motor speed and the braking current in each of the brake control modes.

The resistance value of the discharge resistance is generally varied for the purpose of changing the brake control mode. This necessitates a plurality of resistances, complicating the circuit arrangement. In the embodiment, however, the duty ratio in the PWM control is varied for the purpose of changing the brake control mode. As a result, the circuit arrangement is simplified and the brake control mode can readily be changed.

An electromagnetic brake is applied in the normal stop brake control mode upon at the time of completion of the dehydration step. The electromagnetic brake is also applied in the emergency stop brake control mode when the access lid is opened. When the access lid is opened and then, closed, the rotational speed of the motor 17 is increased after a predetermined period of time. The winding 23 generates heat in the case of the emergency stop brake control mode. The winding 23 further generates heat when the motor 17 is reenergized immediately after application of the electromagnetic brake in the emergency stop brake control mode. If this should be repeated, the winding 23 would be overheated. In the embodiment, however, the drawback can be overcome as described above.

The microcomputer 59 further controls the rotational speed of the motor 17 during the dehydration step on the basis of a detection temperature signal from the thermistor 58 provided for detecting the temperature of the discharge resistance 57. When the detected temperature is low, the motor speed is lowered as much as possible so that an allowed braking current provides an efficient braking. For example, the motor speed is set at 1,000 rpm when the detected temperature is at or below 60° C. The motor speed is set at 700 rpm when the detected temperature is above 60° C. and at or below 80° C. The motor speed is set at 400 rpm when the detected temperature is above 80° C. Consequently, the overheating of the winding 23 can be prevented.

A power stoppage detection signal is supplied from the power stoppage detecting circuit 64 to the microcomputer 59 when a power stoppage occurs during execution of the dehydration step. Based on the supplied power stoppage signal, the microcomputer 59 deenergizes the relay coil 54*a* to return the relay switch to the condition shown in FIG. 1 and applies the electromagnetic brake in the emergency stop brake control mode. The electromotive force of the motor 17 is regenerated through the diode 55 to the side of the dc power supply circuit 52, that is, the dc power supply circuit 55 is electrically charged. As a result, the clutch control motor 42 is supplied with power and the microcomputer 59 is supplied with control power from the voltage regulator circuit 53, whereupon both of them are operable for a certain period of time even after occurrence of the power stoppage. Thus, the microcomputer 59 holds the clutch control motor 42 operative such that the clutch 30 is held operative. Thereafter, power is not supplied from the dc power supply circuit 52 when the above-described electromagnetic brake stops the motor 17 and accordingly, the rotatable tub 4.

The stator 18 of the motor 17 has twelve poles and the rotor 25 thereof has eighteen poles in the embodiment. The maximum rotational speed of the motor 17 is set at 1,000 rpm in the dehydrating operation. Consequently, the maximum values of a commutation frequency and a cogging frequency of the motor drive circuit 63 are set to be at or below 1 kHz. These maximum values are obtained as follows:

$$\text{Maximum commutation frequency} = 12 \times 3 \times (1000\ \text{rpm}/60\ \text{sec}) = 600\ \text{Hz} \quad (5)$$

$$\text{Maximum cogging frequency} = 36 \times (1000\ \text{rpm}/60\ \text{sec}) = 600\ \text{Hz} \quad (6)$$

where numeral "36" is the least common multiple of the numbers of stator and rotor poles. Noise is reduced when the maximum values of commutation frequency and cogging frequency are set as described above. That is, the noise is reduced in a frequency band of or below 1 kHz and is rendered inaudible.

Figure 20:
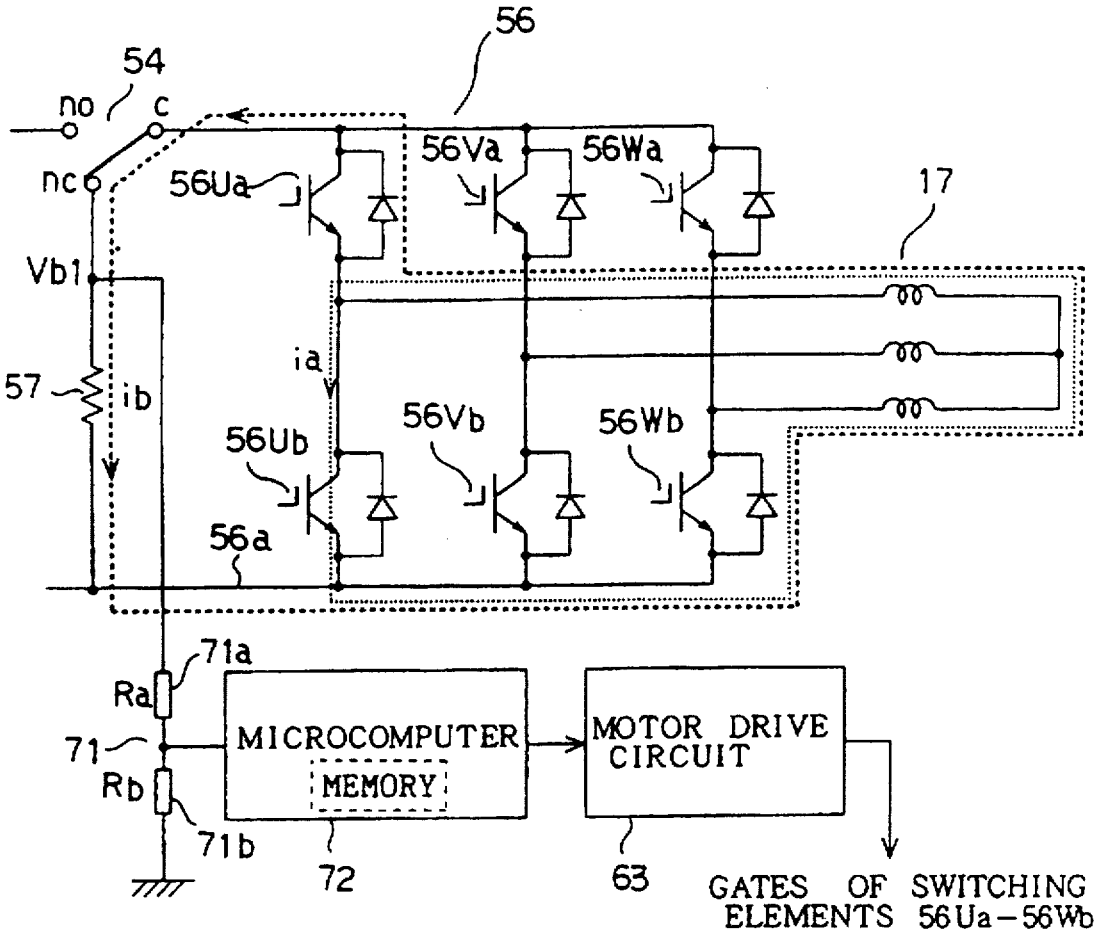
FIG. 20 is a view similar to FIG. 16, showing a washing machine of a second embodiment in accordance with the present invention.
Figure 21:
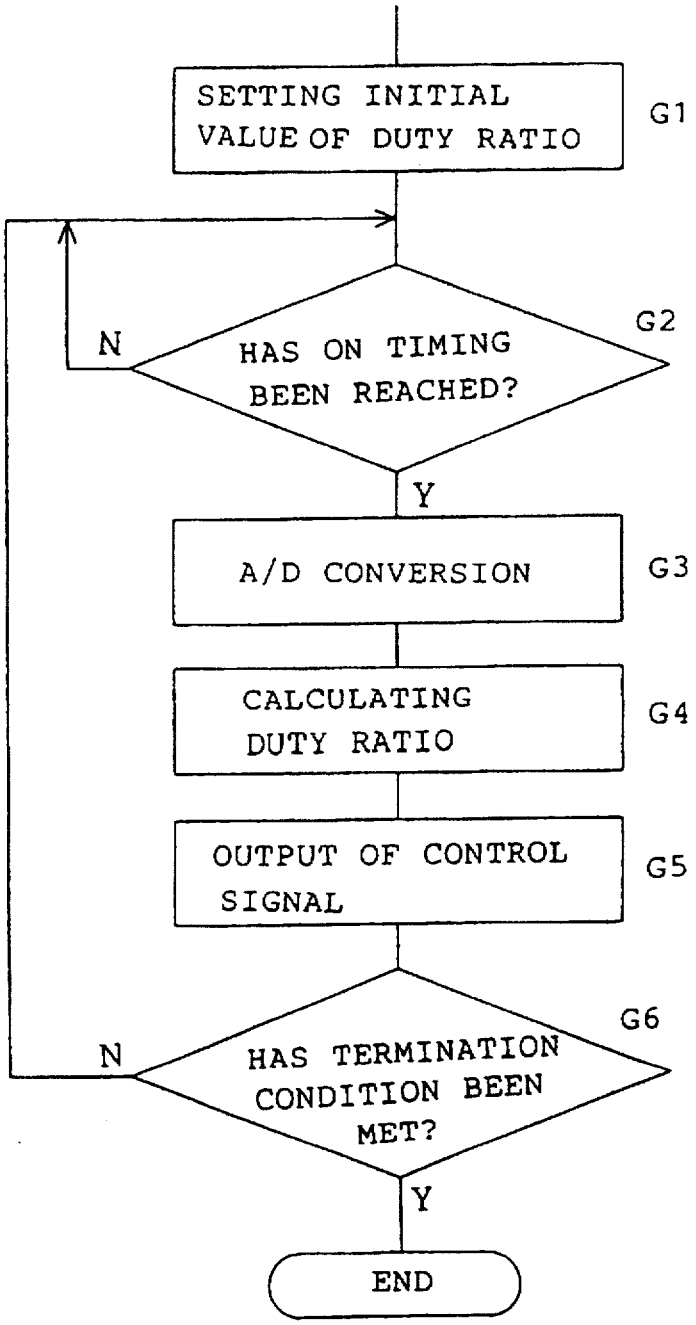
FIG. 21 is a flowchart showing the control contents of the microcomputer in the second embodiment.
Figure 22:
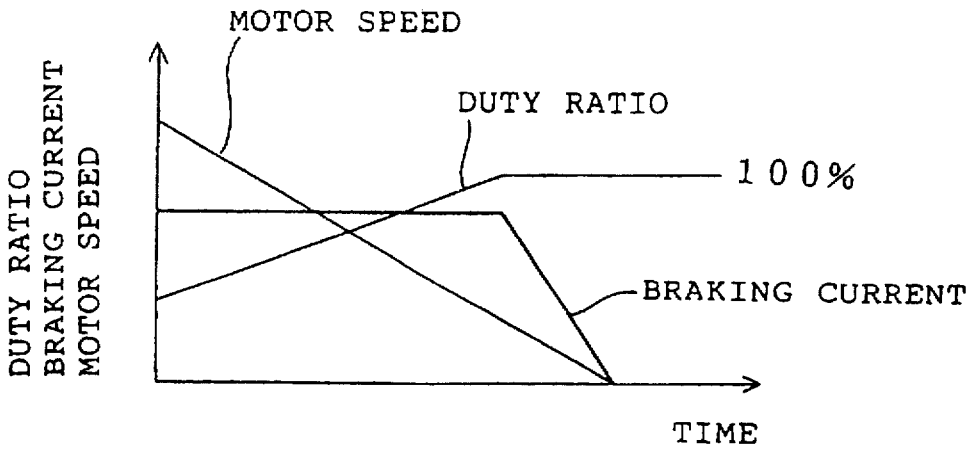
FIG. 22 is a graph showing the relationship among motor speed, duty ratio and braking current.

FIGS. 20 to 22 illustrate a second embodiment of the present invention. A voltage divider circuit 71 is provided for detecting potential difference between both ends of the discharge resistance 57, thereby outputting an analog voltage signal representative of the detected potential difference. The analog voltage signal is converted to a corresponding digital signal, which is supplied to the microcomputer 72. Based on the supplied digital signal, the microcomputer 72 determines the duty ratio for the lower stage switching elements 56U*b*, 56 V*b* and 56 W*b* in the PWM control when the electromagnetic brake is controlled, so that the braking current is rendered constant.

FIG. 21 is a flowchart for the brake control. The initial value of duty ratio in the PWM control is set at step G1. The microcomputer 72 determines whether a turn-on timing in the PWM control has been reached, at step G2. When determining that the turn-on timing has been reached, the microcomputer 72 converts the analog voltage signal supplied from the voltage divider circuit 71 to the digital signal, at step G3. The microcomputer 71 then calculates the duty ratio in the PWM control. When an output voltage $V_{b2}$ is determined by the potential difference $V_{b1}$ between the ends of the discharge resistance 57 and resistance values Ra and Rb of divided resistances 71*a* and 71*b* in the voltage divider circuit 71, the duty ratio V is obtained by the following expression:

$$D=D-K(V_{b2}-V_{br}) \quad (7)$$

where $V_{br}$ is a previously set target value. The relationship between the target value $V_{br}$ and the braking current $i_{brk}$ is shown by the following expression (8):

$$i_{brk}=(Ra+Rb)\times V_{br}/(Rb\times R) \quad (8)$$

where R is a resistance value of the discharge resistance 57.

The microcomputer 71 delivers the obtained duty ratio as a control signal to the motor drive circuit 63, at step G5. The microcomputer 72 determines whether a termination condition has been met or whether the rotational speed has been reduced to or below a predetermined value, at step G6. The brake control is terminated when the termination condition has been met. The target value $V_{br}$ is set at different values between the normal stop brake control mode and the emergency stop brake control mode. Furthermore, the initial value is also set at different values between the normal stop brake control mode and the emergency stop brake control mode or is varied in accordance with the dehydrating rotational speed.

In the second embodiment, the braking current can be control to be constant without provision of dedicated current detecting means between the inverter main circuit 56 or a power line 56*a* thereof and the motor 17 (see FIG. 22). Consequently, the stopping time can be shortened. When the power line 56*a* is provided with a current detecting resistance, a negative power supply is required since the current to be detected flows in the opposite direction to the current during drive of the motor 17. In the embodiment, however, no such negative power supply is required.

Figure 23:
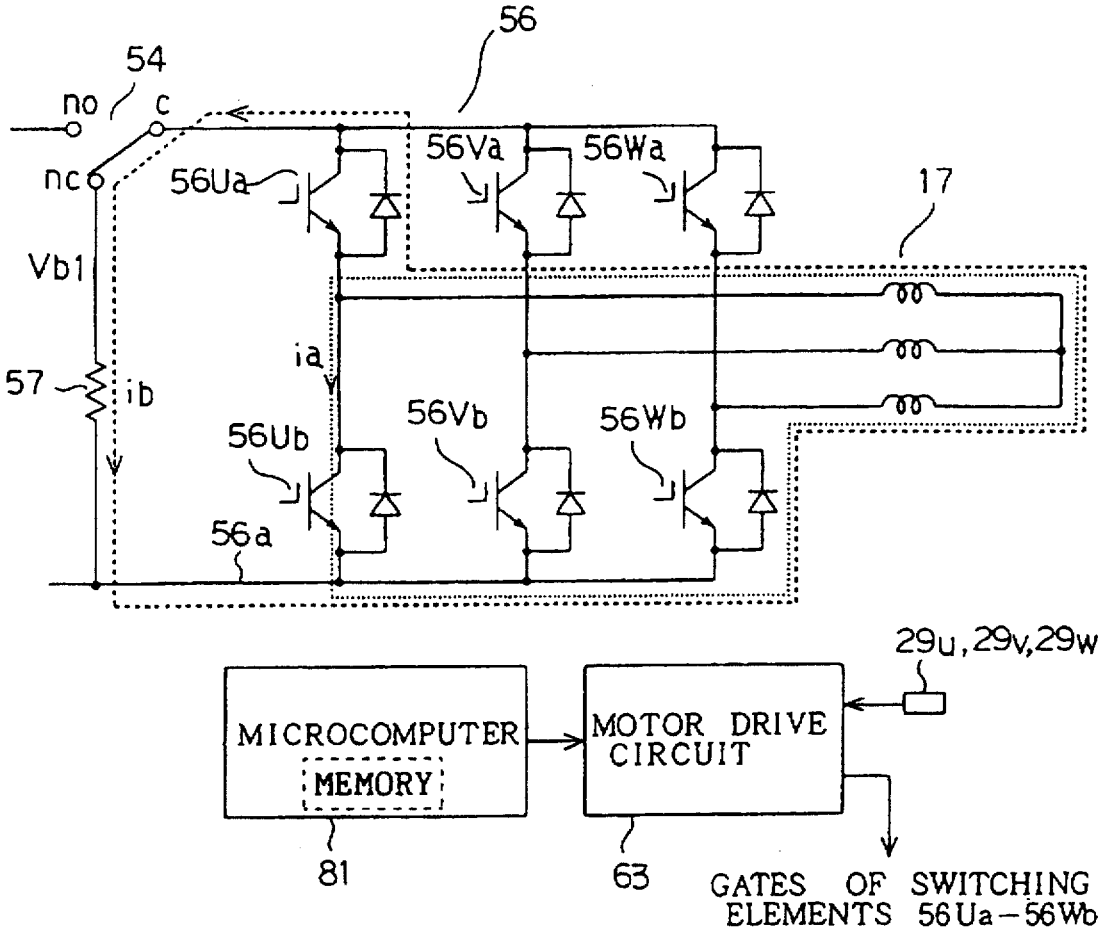
FIG. 23 is a view similar to FIG. 20, showing a washing machine of a third embodiment in accordance with the present invention.
Figure 24:
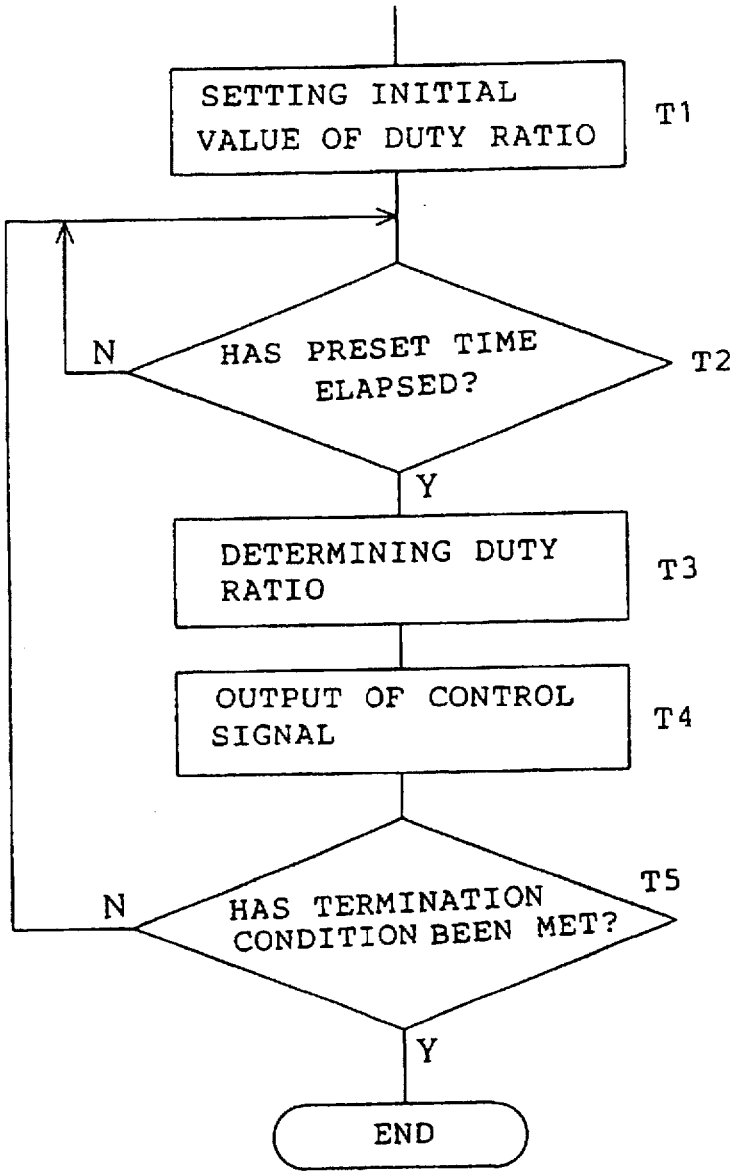
FIG. 24 is a flowchart showing the control contents of the microcomputer in the third embodiment.

FIGS. 23 and 24 illustrate a third embodiment of the present invention. The braking current is rendered constant on the basis of a rotational speed detection signal. Based on the position detection signals supplied through the motor drive circuit 63 from the Hall elements 29*u*, 29*v* and 29*w*, the microcomputer 81 controls the duty ratio in the PWM control. When the motor 17 has twelve poles, the rotational speed N thereof is shown by the following expression (9):

$$N=2/(12\times Th) \quad (9)$$

where Th is an input period of the position detection signal.

The microcomputer 81 determines the duty ratio in the PWM control in the intervals of predetermined period, for example, 500 μsec, as shown by steps T2 and T3 in FIG. 23. The determination is based on experimentally obtained data. More specifically, the microcomputer 81 is incorporated with a memory storing, as table data, experimental data of duty ratios obtained according to the motor speeds, in which duty ratios the braking current reaches the target value ic. The table data is referred to in the determination of the duty ratio. The above-mentioned target value ic has different values between the normal stop brake control mode and the emergency stop brake mode. The same effect can be achieved in the third embodiment as in the second embodiment.

Figure 25:
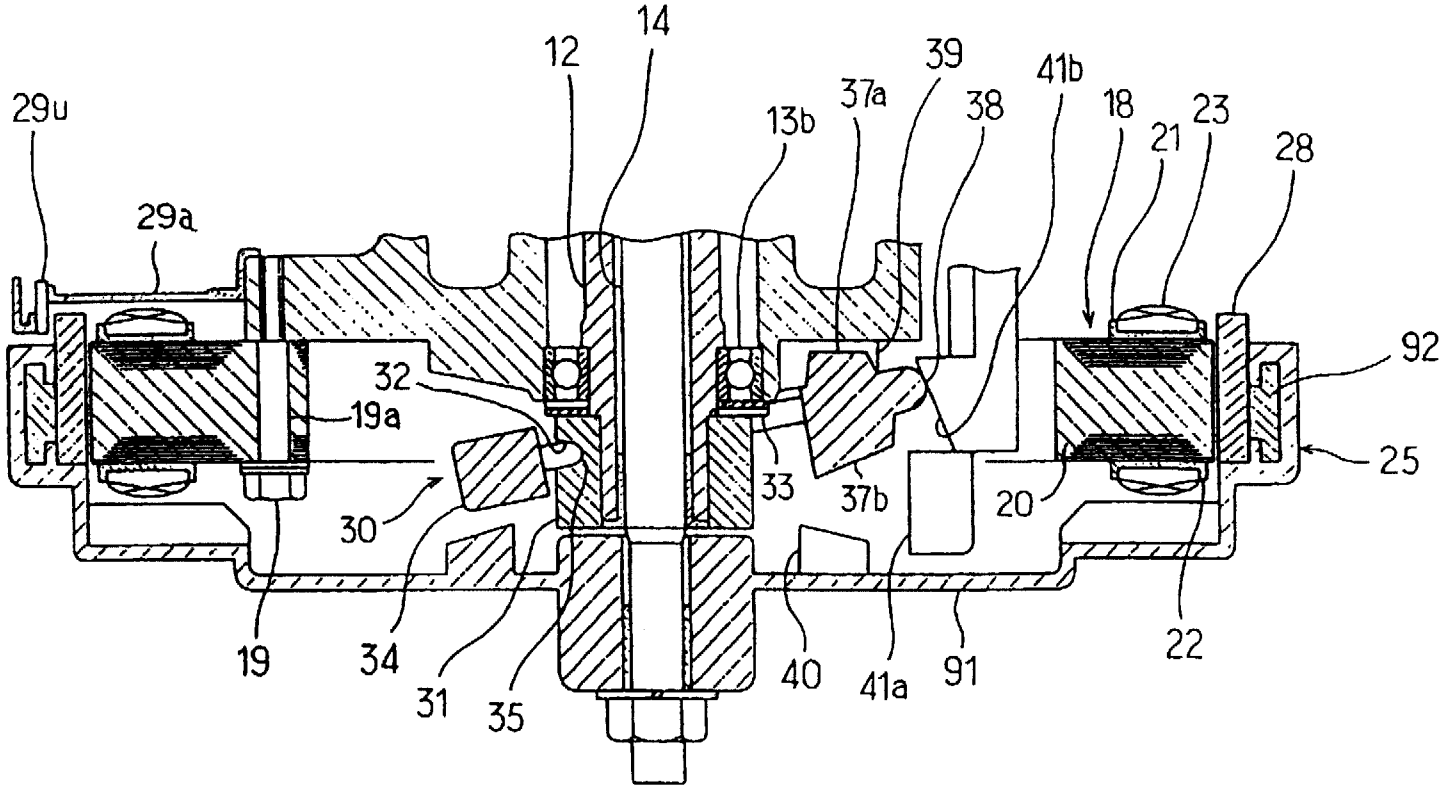
FIG. 25 is a partial longitudinal section of the mechanism section of a washing machine of a fourth embodiment in accordance with the present invention.

FIG. 25 illustrates a fourth embodiment of the present invention. The rotor 25 of the motor 17 comprises a rotor housing 91 formed from aluminum by die casting and a rotor yoke 92 formed in the rotor housing 91 by insert molding. Consequently, the number of assembly steps can be reduced and the rotor yoke 92 can reliably be secured to the rotor housing 91.

Figure 26:
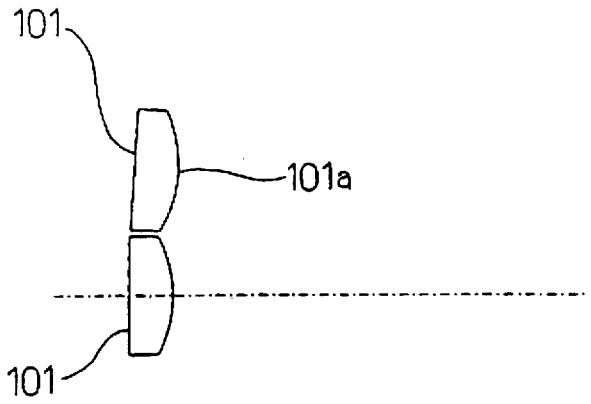
FIG. 26 is a plan view of rotor magnets employed in a washing machine of a fifth embodiment in accordance with the present invention.
Figure 27:
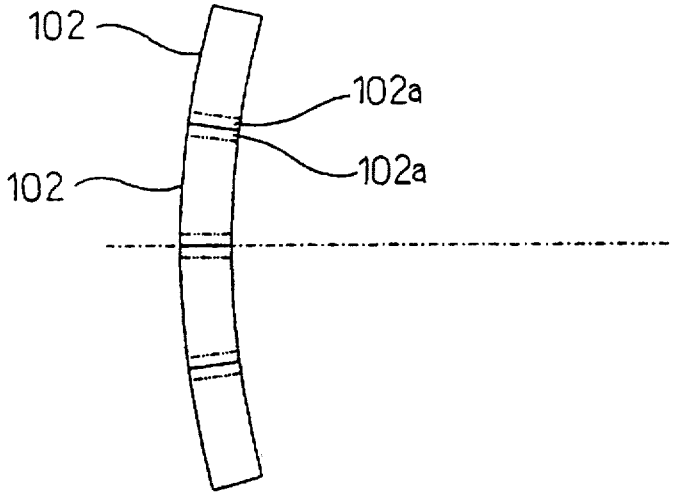
FIG. 27 is a plan view of rotor magnets employed in a washing machine of a sixth embodiment in accordance with the present invention.

FIG. 26 illustrates a fifth embodiment of the present invention. Each rotor magnet 101 of the rotor 25 is configured so as to have a smaller thickness in ends thereof. For example, each rotor magnet 101 is configured so as to have an arcuately convex inner surface 101*a*. As a result, the cogging torque can be reduced. The same effect can be achieved when each rotor magnet 102 is formed in opposite ends with unsaturated magnetized portions 102*a* respectively as shown in FIG. 27 as a sixth embodiment.

Figure 28:
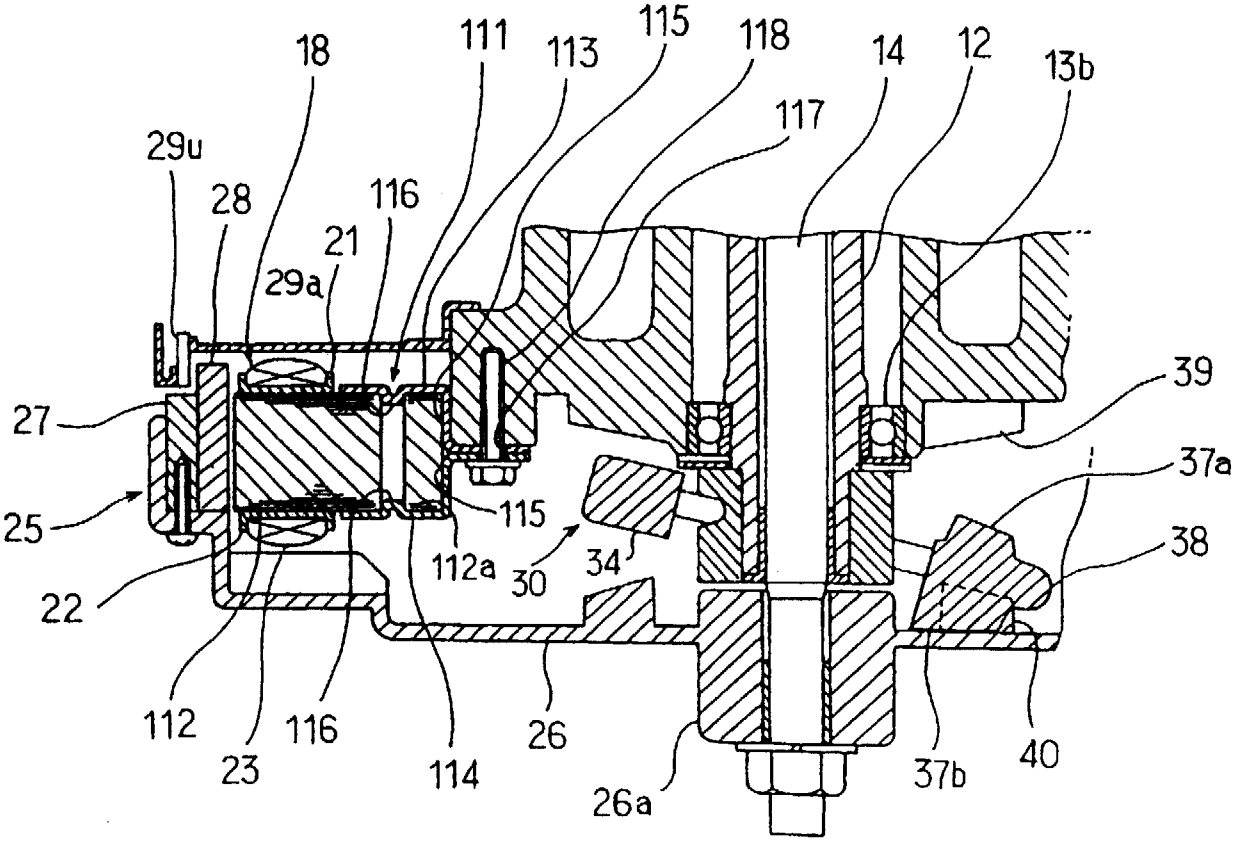
FIG. 28 is a partial longitudinal section of the mechanism section of a washing machine of a seventh embodiment in accordance with the present invention.
Figure 29:
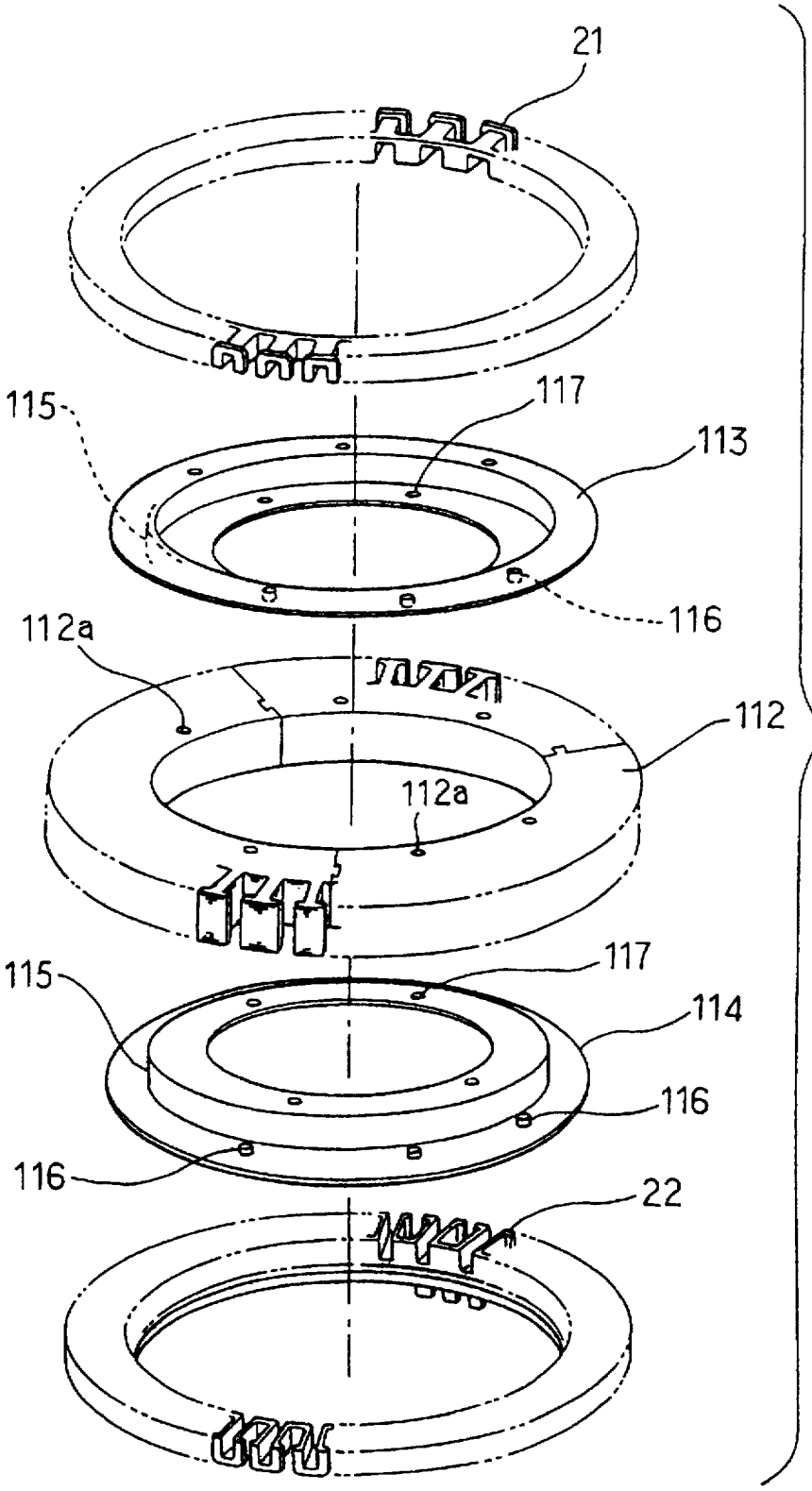
FIG. 29 is an exploded perspective view of the motor stator.

FIGS. 28 and 29 illustrate a seventh embodiment of the present invention. The stator 111 comprises an annular laminated core 112 formed with a plurality of fit holes 112*a* and two presser plates 113 and 114 holding the core 112 therebetween. Each presser plate is formed with an annular stepped portion 115 and a plurality of convex portions 116 fitted in the fit holes 112*a* of the core 112 respectively. Each presser plate ic further formed with a plurality of screw holes 117 into which screws 118 are screwed so that each presser plate is secured to the mechanism base 10.

The stepped portion 115 of each presser plate is fitted into the laminated core 112 to thereby maintain the circularity of the latter. Furthermore, the convex portions 116 of each presser plate are fitted into the fit holes 112*a* of the core 112 such that rotation of the stator 111 can be prevented.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. A washing machine comprising:

a hollow tub shaft mounted on a first stationary portion of the machine for rotation;

a rotatable tub rotatably mounted on an upper end of the tub shaft;

an agitator shaft concentrically inserted in the tub shaft for rotation and having upper and lower ends projecting out of the tub shaft;

an agitator mounted on the upper end of the agitator shaft to be located in the rotatable tub;

a stator fixed to a second stationary portion of the machine to be concentric with the agitator shaft;

a rotor mounted on the lower end of the agitator shaft to constitute an electric motor together with the stator; and a clutch including a holder provided on the tub shaft for rotation with the latter, a first engagement portion formed in a third stationary portion of the machine, a second engagement portion formed in the rotor, a lever provided on the holder to be selectively engaged with one of the first and second engagement portions, the lever operatively coupling the rotor to the agitator shaft when engaged with the first engagement portion, the lever operatively coupling the rotor to both of the agitator and tub shafts when engaged with the second engagement portion, and toggle type springs holding the lever in engagement with the first and second engagement portions respectively, the clutch being actuated so that the rotor of the motor is operatively coupled to the agitator shaft to thereby drive the agitator for execution of a wash step of a washing operation and so that the rotor of the motor is operatively coupled to both of the agitator and tub shafts to drive the agitator and the rotatable tub for execution of a dehydration step of the washing operation.

2. A washing machine according to claim 1, wherein the rotor comprises a rotor housing, an annular rotor yoke mounted on the rotor housing, and a plurality of rotor magnets mounted on the rotor housing, the rotor yoke being standardized.

3. A washing machine according to claim 1, wherein the rotor comprises a rotor housing formed from aluminum by die-casting, a rotor yoke formed on the rotor housing by an insert molding, and a plurality of rotor magnets.

4. A washing machine according to claim 1, wherein the rotor includes a plurality of rotor magnets each of which constitutes one pole and each rotor magnet has opposite ends each having a reduced thickness.

5. A washing machine according to claim 1, wherein the rotor includes a plurality of rotor magnets having both pole chips formed with respective unsaturated magnetization portions.

6. A washing machine according to claim 1, wherein the stator includes a slotted iron core having unequal slot pitches.

7. A washing machine according to claim 1, wherein the stator includes a slotted iron core having teeth, the rotor includes a plurality of rotor magnets, and a gap between distal ends of the stator teeth and distal ends of the rotor magnets is non-uniform.

8. A washing machine according to claim 1, wherein the motor comprises a brushless motor and the number of stator poles, the number of rotor poles and a maximum rotational of the brushless motor are so determined that a commutation frequency is 1 kHz or below 1 kHz.

9. A washing machine according to claim 1, wherein the motor comprises a brushless motor and the number of stator poles, the number of rotor poles and a maximum rotational speed of the brushless motor are so determined that a cogging frequency is 1 kHz or below 1 kHz.

10. A washing machine according to claim 1, wherein the stator includes an annular wound iron core formed by combining unit iron cores together and the number of the unit iron cores is obtained by dividing 360 degrees by a divisor or the number of poles of the stator.

11. A washing machine according to claim 1, wherein the stator has a plurality of screw holes into which a plurality of stepped screws are screwed to thereby fix the stator on the second stationary portion and the stepped screws have straight portions inserted into the screw holes respectively such that the stator is positioned.

12. A washing machine according to claim 1, wherein the stator includes a laminated iron core having a plurality of concave portions, two presser plates having respective annular stepped portions holding the laminated core therebetween, each presser plate having a plurality of convex portions fitted into the concave portion of the laminated core respectively.

13. A washing machine according to claim 1, wherein the rotor includes a rotor housing, a rotor yoke mounted on the rotor housing, and rotor magnets mounted on the rotor housing each to slightly project from the rotor yoke, and which further comprises position detecting means for detecting a rotational position of the rotor, the position detecting means comprising magnetic detecting elements disposed to be opposite to projected portions of the rotor magnets.

14. A washing machine according to claim 1, further comprising a motor drive circuit including a dc power supply circuit and a three-phase inverter main circuit for converting dc power to ac power, the three-phase inverter main circuit including a plurality of switching elements, and electromagnetic brake control means for controlling the switching elements of the inverter main circuit by means of a PWM control so that a motor electromotive force produces a braking current, the electromagnetic brake control means being adapted to change modes of the PWM control to thereby selectively execute an emergency stop brake control mode or a normal stop brake control mode.

15. A washing machine according to claim 14, wherein a rotational speed of the rotatable tub is prevented from being increased for a predetermined period of time after the brake control has been executed in the emergency stop brake control mode by the electromagnetic brake control means.

16. A washing machine according to claim 1, further comprising a motor drive circuit including a dc power supply circuit and a three-phase inverter main circuit for converting dc power to ac power, the three-phase inverter main circuit including a plurality of switching elements, electromagnetic brake control means for controlling the switching elements of the inverter main circuit by means of a PWM control so that a motor electromotive force produces a braking current, temperature detecting means for detecting a temperature of an electrical component consuming a braking current, and operation control means for controlling a rotational speed of the rotatable tub in accordance with results of the temperature detection by the temperature detecting means.

17. A washing machine according to claim 1, further comprising a motor drive circuit including a dc power supply circuit and a three-phase inverter main circuit for converting dc power to ac power, the three-phase inverter main circuit including a plurality of switching elements, and electromagnetic brake control means for controlling the switching elements of the inverter main circuit by means of a PWM control so that a motor electromotive force produces a braking current, the electromagnetic brake control means including switching means for switching between a case where the dc power supply circuit is connected to the inverter main circuit during a normal operation of the machine and a case where the dc power supply circuit is disconnected from the inverter main circuit and the inverter main circuit is short-circuited between both input side ends thereof with a discharge element being interposed between the input side ends during execution of the brake control or power turnoff.

18. A washing machine according to claim 1, further comprising a motor driven circuit including a dc power supply circuit and a three-phase inverter main circuit for converting dc power to ac power, the three-phase inverter main circuit including a plurality of switching elements, and electromagnetic brake control means for controlling the switching elements of the inverter main circuit by means of a PWM control so that a motor electromotive force produces a braking current, the electromagnetic brake control means including switching means for switching between a case where the dc power supply circuit is connected to the inverter main circuit and a case where the dc power supply circuit is disconnected from the inverter main circuit and the inverter main circuit is short-circuited between both input side ends thereof with a discharge element being interposed between the input side ends, the brake control means controlling the switching elements of the inverter main circuit by means of the PWM control in accordance with a difference between potentials of both ends of the discharge element.

19. A washing machine according to claim 1, further comprising a motor drive circuit including a dc power supply circuit and a three-phase inverter main circuit for converting dc power to ac power, the three-phase inverter main circuit including a plurality of switching elements, and electromagnetic brake control means for controlling the switching elements of the inverter main circuit by means of a PWM control so that a motor electromotive force produces a braking current, the electromagnetic brake control means including switching means for switching between a case where the dc power supply circuit is connected to the inverter main circuit and a case where the dc power supply circuit is disconnected from the inverter main circuit and the inverter main circuit is short-circuited between both input side ends thereof with a discharge element being interposed between the input side ends, the brake control means controlling the switching elements of the inverter main circuit by means of the PWM control in accordance with a rotational speed of the motor.

20. A washing machine according to claim 1, further comprising a motor drive circuit including a dc power supply circuit and a three-phase inverter main circuit for converting dc power to ac power, the three-phase inverter main circuit including a plurality of switching elements, electromagnetic brake control means for controlling the switching elements of the inverter main circuit by means of a PWM control so that a motor electromotive force produces a braking current, and control means provided for controlling operation of the machine and supplied with power from the dc power supply circuit of the motor drive circuit, wherein the brake control means executes a braking operation when a power stoppage has occurred during the dehydration step, and wherein the dc power supply circuit is charged by means of a motor electromotive force.

21. A washing machine according to claim 20, further comprising lever actuating means for actuating the lever of the clutch, the lever actuating means being supplied with power from the dc power supply circuit of the motor drive circuit, the lever being actuated to hold the rotatable tub in a coupled state to the motor rotor when a power stoppage has occurred during execution of the dehydrating step.

22. A washing machine according to claim 1, further comprising a motor drive circuit including a dc power supply circuit and a three-phase inverter main circuit for converting dc power to ac power, a plurality of position detecting elements each for detecting a rotational position of the rotor, thereby generating position detection signals, and control means for controlling a washing operation, the control means having a memory storing data of a plurality of motor energization patterns determined according to the position detection signals generated by the position detecting elements, and wherein one of the energization patterns is selected in accordance with an operation mode and a rotational speed of the motor.

23. A washing machine according to claim 22, further comprising a motor drive circuit including a dc power supply circuit and a three-phase inverter main circuit for converting dc power to ac power, the three-phase inverter main circuit including a plurality of switching elements, and electromagnetic brake control means for controlling the switching elements of the inverter main circuit by means of a PWM control so that a motor electromotive force produces a braking current, and wherein a duty ratio in the PWM control is varied when the energization pattern is switched from one to another.

24. A washing machine according to claim 22, wherein a rotational speed control gain is adjusted during drive of the motor in each energization pattern.

25. A washing machine according to claim 1, wherein the tub shaft has a flat face formed on an outer circumferential surface thereof and the holder has a hole into which the flat face of the shaft is fitted such that the holder is prevented from rotation.

26. A washing machine according to claim 1, wherein the tub shaft is rotatably mounted on bearing means further mounted on the first stationary portion and the bearing is provided with pressing means for pressing the bearing means axially of the tub shaft.

* * * * *